US007287784B2

(12) United States Patent
Lin

(10) Patent No.: US 7,287,784 B2
(45) **Date of Patent: *Oct. 30, 2007**

(54) FIRE-BLOCKING DOOR LOCK STRUCTURE

(76) Inventor: Ching-Tien Lin, No. 2, Lane 112, Chu-Yuan Road, Hsin-Chung, Taipei Hsien (TW)

( * ) Notice: Subject to any disclaimer, the term of this patent is extended or adjusted under 35 U.S.C. 154(b) by 107 days.

This patent is subject to a terminal disclaimer.

(21) Appl. No.: 10/833,144

(22) Filed: Apr. 28, 2004

(65) Prior Publication Data

US 2004/0227352 A1 Nov. 18, 2004

(30) Foreign Application Priority Data

May 14, 2003 (TW) ..... 92208759 U

(51) Int. Cl.
*E05B 65/10* (2006.01)
*E05B 3/00* (2006.01)

(52) U.S. Cl. ..... 292/92; 292/93; 292/DIG. 65

(58) Field of Classification Search ..... 292/92, 292/93, 336.3, DIG. 65; 70/92
See application file for complete search history.

(56) References Cited

U.S. PATENT DOCUMENTS 1,346,670 A * 7/1920 Page ..... 70/92
3,583,740 A * 6/1971 Armstrong ..... 292/198
3,663,047 A * 5/1972 Zawadzki ..... 292/92
3,730,574 A * 5/1973 Zawadzki ..... 292/92
3,788,687 A * 1/1974 Zawadzki ..... 292/92
4,167,280 A * 9/1979 Godec et al. ..... 292/92
4,961,330 A * 10/1990 Evans ..... 70/21
5,011,199 A * 4/1991 Lowe et al. ..... 292/92
5,067,757 A * 11/1991 Cohrs et al. ..... 292/336.3
5,085,475 A * 2/1992 Austin et al. ..... 292/92
5,114,192 A * 5/1992 Toledo et al. ..... 292/21
5,816,017 A * 10/1998 Hunt et al. ..... 52/784.11
6,032,985 A * 3/2000 Cutter ..... 292/92
6,048,000 A * 4/2000 Geringer et al. ..... 292/92
6,189,939 B1 * 2/2001 Zehrung ..... 292/92
6,623,050 B1 * 9/2003 Peng ..... 292/92
6,641,183 B2 * 11/2003 Brown ..... 292/92
6,854,773 B2 * 2/2005 Lin ..... 292/92
7,144,050 B2 * 12/2006 Lin ..... 292/93

* cited by examiner

*Primary Examiner*—Carlos Lugo
(74) *Attorney, Agent, or Firm*—Shoemaker and Mattare

(57) ABSTRACT

A fire-blocking door lock structure is mounted on a fire-blocking door including a frame member, a push handle and a casing. The casing has the bottom thereof fixed to a plate member and connected to a base body. The fire-blocking door lock structure includes a middle latch mechanism mounted in the casing, an upper latch mechanism and a lower latch mechanism symmetrically mounted on opposite sides of the middle latch mechanism and connected to the middle latch mechanism, and an actuation mechanism connected to the middle latch mechanism. When the push handle is pressed, the actuation mechanism is driven to actuate the middle latch mechanism, and the upper latch mechanism and the lower latch mechanism are simultaneously actuated by the middle latch mechanism to unlatch the door lock. When the push handle is released, the door lock is restored to the lock-up status.

14 Claims, 18 Drawing Sheets

FIRE-BLOCKING DOOR LOCK STRUCTURE

FIELD OF THE INVENTION

The invention relates to fire-blocking door lock structures, and more particular, to a fire-blocking door lock suitable for a fire-blocking door, with concealed hinges formed on the top and bottom of the door lock.

BACKGROUND OF THE INVENTION

A general fire-blocking door lock structure is shown in FIGS. 13 and 14. Such fire-blocking door lock structure comprises a frame member 10 having a push handle 11, which is mounted on the frame member 10 for being pressed down by hand, and a casing 12 connected with a latch body 12*d*.

As shown in the drawings that the push handle 11 is screwed and mounted on the bottom inside the frame member 10 and two fixed supports 13 are connected to the frame member 10 on the bottom inside. Two chutes 13*a* are installed on both sidewalls of fixed supports 13, respectively, for a sliding shaft 13*b* to be positioned in-between and fixed on the sidewalls of the push handle 11 by a pin 13*c*. Meanwhile, a spiral spring 13*d* is penetratingly secured on the front bottom of each said fixed support 13 by a set pin 13*e*. Under a normal condition, the spiral spring 13*d* has its one end abutting on the bottom of the sliding shaft 13*b* with an upward pressure whereon. Therefore, when the door is closed, the pin 13*c* penetratively set in the sliding shaft 13*b* enabling the push handle 11 to be urged against on the top of the frame member 10.

The casing 12 is mounted on the front end of the frame member 10 comprising an actuating piece 12*a* having a driving portion 12*b* extended to one end and a passive portion 12*c* extended to the other end. The driving portion 12*b* has its one end abutting on the inner part of the push handle 11; whereas the passive portion 12*c* is in contact with a stop portion 12*e* inside the latch body 12*d* in the casing 12.

The casing 12 further has a bar link 12*f* penetratively set inside thereof for latching and unlatching the door lock. The bar link 12*f* has both of the ends thereof connected with a first latch body 12*g* and a second latch body 12*h*, respectively; in addition, has a connecting link 12*i* set whereon. Two linking pieces 12*j* are positioned between the connecting link 12*i* and one end of the actuating piece 12*a*. When the actuating piece 12*a* is nudged and swung, the linking pieces 12*j* are jointly swung; thereby the connecting link 12*i* can be nudged to move the bar link 12*f*. The first latch body 12*g* and the second latch body 12*h* are positioned inside latch body supports 12*k* and 12*l* and pivotally connected to driving pieces 12*m* and 12*n*, respectively. The driving pieces 12*m* and 12*n* are separately connected to the bar link 12*f*, thereby enabling the first latch body 12*g* and the second latch body 12*h* to be pulled by the bar link 12*f*.

The bar link 12*f* is further linked with a holdfast member 12*p*, which is positioned inside the frame member 10 away from the casing 12. The holdfast member 12*p* comprises a clamp 12*q* with a hook portion and an operating piece 12*r*. The operating piece 12*r* is coaxial to and clenched the clamp 12*q*. The hook portion of the clamp 12*q* can be pivotally turned corresponding to an axis between a first and a second positions; among which the first position is at the position of the bar link 12*f* for clenching and opening the door latch; where the second position is at the position of the bar link 12*f* for unclenching and opening the door latch. A spring 12*s* is placed at any position of either the first position or the second position biased with the clamp 12*q*, in addition, an axial extension piece 12*t* is used for axially holding the operating piece r and the clamp 12*q*.

When the push handle 11 positioned on the center of the door inside the frame member 10 is pressed down, the driving portion 12*b* of the actuating piece 12*a* is forced to move downwards by the pressure, thereby impelling the passive portion 12*c* on the other side thereof to move upwards. Meanwhile, the passive portion 12*c* has the end thereof abutting on the latch body 12*d* around the stop portion 12*e* and turning in the counterclockwise direction; thereby the bar link 12*f* is able to shift the first latch body 12*g* and the second latch body 12*h*. Consequently, the latch body 12*d* can be retracted into a slide support 12*o* in the casing 12, in addition, the first latch body 12*g* and the second latch body 12*h* are forced to shift toward the direction of the latch body 12*d*, thereby unlatching the door.

In view of the motion of unlatching the said conventional fire-blocking door lock, in spite that a user can perpendicularly press down the push handle 11 by hand, the push handle 11 is moved along the slant direction of chutes 13*a* on the fixed support 13 inside the frame member 10, that is, the push handle 11*a* is perpendicularly and horizontally moved along the chutes 13*a*. Therefore, the physical strength by the user's hand on the push handle 11 is decomposed into a perpendicular force for jointly actuating the latch body 12*d* and a horizontal force having no effect on the latch body 12*d*; consequently, the user must exert greater strength on the push handle 11. Moreover, excessive force on the latch body 12*d* could cause damage to the door latch.

In the meantime, a horizontal force is generated when the push handle 11 is shifted along the chutes 13*a*, the direction of such a horizontal force is different from that of a force pressed down by a user, so as to cause an uncomfortable feeling of a user and the inconvenience of unlatching and latching the fire-blocking door when the user presses down the push handle. Moreover, the hook portion of the holdfast member 12*p* pivotally turned corresponding to an axis between the first and the second positions is easily departed from the original position due to a strike or destruction by intention, thereby the efficacy of the operating piece 12*r* in the latch is failed. The spring 12*s* placed at either of the first or the second positions then fails to be biased with the clamp 12*q* without appropriate retaining force, thereby the operating piece r and the clamp 12*q* can not be properly actuated.

In addition, even though the first latch body 12*g* and the second latch body 12*h* can be pulled by the bar link 12*f*, the latch bodies 12*g* and 12*h* and the bar link 12*f* can merely be driven by the driving pieces 12*m* and 12*n* connected to the bar link 12*f* when the door lock is unlatched. While under the pressure, both of the first latch body 12*g* and the second latch body 12*h* are displaced or swung without proper support or actuating mechanism applied, such that the first latch body 12*g* and the second latch body 12*h* can not be surely moved toward the direction of the latch body 12*d* for successfully unlatching the door.

Moreover, as there is no an appropriate restorable force provided by any structure or components among the first latch body 12*g*, the second latch body 12*h* and the bar link 12*f*, therefore, when the opened door is locked up, the first latch body 12*g* and the second latch body 12*h* can not be easily restored to the original positions; or the lock of the door latch is easily damaged owing to an external force or improper beats or strikes. Said damages to the door latch not only easily shorten the lifespan of the door latch, but also result in the problem of failing to latch or unlatch the door lock.

The said conventional fire-blocking door lock structure has various problems; for example, the door lock structure requires a greater physical strength to actuate the door latch, and in addition, the lifespan of the door latch is easily shortened and the efficacy of a fire-blocking door usage is reduced without any proper support, actuating mechanisms and restorable force by various door lock components. It is obvious that such a conventional fire-blocking door lock structure requires to be improved.

SUMMARY OF THE INVENTION

In view of said prior technique of a conventional fire-blocking door lock, the primary objective of the present invention is to provide a fire-blocking door structure enabling a fire-blocking door to be securely latched with a good condition when the fire-blocking door is closed.

Another objective of the present invention is to provide a fire-blocking door lock, which enables a door lock to be easily unlatched by a press force.

Another objective of the present invention is to provide modularized components for the fire-blocking door lock structure.

Another objective of the present invention is to provide a fire-blocking door lock structure, which has a longer lifespan for door latch usage.

To achieve said and other objectives, the present invention provides a fire-blocking door lock structure mounted on said fire-blocking door plank selectively comprising a frame member, a push handle and a casing. The fire-blocking door lock structure can be installed on a constituent body formed by said frame member, said push handle, and said casing on a fire-blocking door plank. The casing has the bottom thereof mounted on a base body and connected to a frame plate. The fire-blocking door lock structure mainly comprises a middle latch mechanism, an upper latch mechanism, a lower latch mechanism and an actuation mechanism connected to the middle latch mechanism; both of the upper and the lower latch mechanisms are symmetrically installed on both sides of the middle latch mechanism.

The middle latch mechanism comprises a slide support, a latch block pivotally and shiftably installed inside the slide support, two driving pieces smoothly shifted and separately joined to the slide support and the latch block, and two pairs of sliding blocks that are driven by the driving pieces by dint of pins piercing through the driving pieces. The slide support is roughly mounted on the center of the base body inside the casing. The driving pieces are pivotally positioned in the center of the base body and rotated smoothly. The latch block is connected to the slide support and pierced through by a pin to a hole at the front end of the slide support. The recess portion of the latch block enables the latch block not to be contacted with the casing while the latch block is retracted inside and extended outside the slide support. The sliding blocks are movably, pivotally installed inside the sliding block supports in the opposite directions on both lateral sides of the base body and pivotally joined to the driving pieces.

The upper latch mechanism and the lower latch mechanism are connected to the middle latch mechanism on both sides thereof, in addition, each comprises a latching frame, a latching support movably positioned inside the latching frame, a latching body rotatably positioned inside the latching support, a stop piece movably positioned between the latching frame and the latching support and a driving piece, which has one end thereof pivotally connected with the stop piece and the other end connected to a pull rod, thereby a force from the pull rod is used for shifting the stop piece and the latching body.

The actuation mechanism connected to the middle latch mechanism comprises more than one revolving pieces and a draft bar, enabling both sides of the push handle of the fire-blocking door lock to be connected to an upper support. The revolving pieces are pivotally secured to the inside of the upper support; the draft bar is fixedly secured to linking pieces of the latch block by a pin and connected to the rear end of the slide support, thereby the revolving pieces having one end thereof under a perpendicularly downward force, when the push handle on the upper support is pressed down. Consequently, the revolving pieces are rotated along holes on the lower support, thereby the revolving pieces have the other end thereof swung and the draft bar is pivotally secured, nudged and axially displaced. Being pulled by the draft bar of the actuation mechanism, the latch block of the middle latch mechanism is then swung and actuated the middle latch mechanism, the upper latch mechanism and the lower latch mechanism, respectively.

When the push handle is pressed down by a user driving the actuation mechanism to unlatch the door lock, the middle latch mechanism is driven by the linking pieces enabling the latch block inside thereof to actuate the driving pieces and the pull rods, thereby enabling connecting units of the pull rods to actuate the latching supports and the driving pieces inside both of the upper and the lower latch mechanisms; in addition, the driving pieces are able to change the positions of the stop pieces in order to simultaneously drive the latching bodies retract inside the latching supports. Therefore, by dint of actuating the middle latch mechanism under the motion of the actuation mechanism, the pull rods are driven to simultaneously actuate the upper latch mechanism and the lower latch mechanism; thereupon all constituent parts are driven for unlatching the door locks.

When the pressure actuating the actuation mechanism is released, the middle latch mechanism is restored back to the original latched position, consequently, the force of driving the pull rods is disappeared, thereby both of the latching supports and the driving pieces can be restored back to the original positions by an elastic power that is a compressed force of a second spiral spring generated when the lock is unlatched. Moreover, the second spiral spring positioned between the driving piece and the latching frame is used for restoring the stop piece back to the original position by the driving piece, thereby the stop piece is urged against the latching body and the latching body is surely restored to the position outside the latching member and retained on that position; thereupon all constituent parts are simultaneously driven for latching the door locks.

Consequently, the fire-blocking door lock structure of the present invention can enable a fire-blocking door lock to be securely latched and kept in a good lock-up condition when the fire-blocking door is closed. The present invention, therefore, can truly improve various drawbacks of a conventional fire-blocking door lock structure, enabling a user to easily use the fire-blocking door lock of the present invention, enabling the door to be easily opened by a press force, enabling the components and parts to be modularized and enabling the lifespan of the door latch to be prolonged; thereby maintaining the secured efficacy of using the fire-blocking door lock.

The brief description of the drawing below is followed by the detailed description of the preferred embodiments. It is understood that the drawings described herein are merely illustrative of the principles of the invention, not to be interpreted as limiting the present invention.

BRIEF DESCRIPTION OF THE DRAWINGS

The present invention can be more fully understood by reading the following detailed description of the preferred embodiments, with reference made to the accompanying drawings, wherein.

DETAILED DESCRIPTION OF THE PREFERRED EMBODIMENTS

Figure 1:
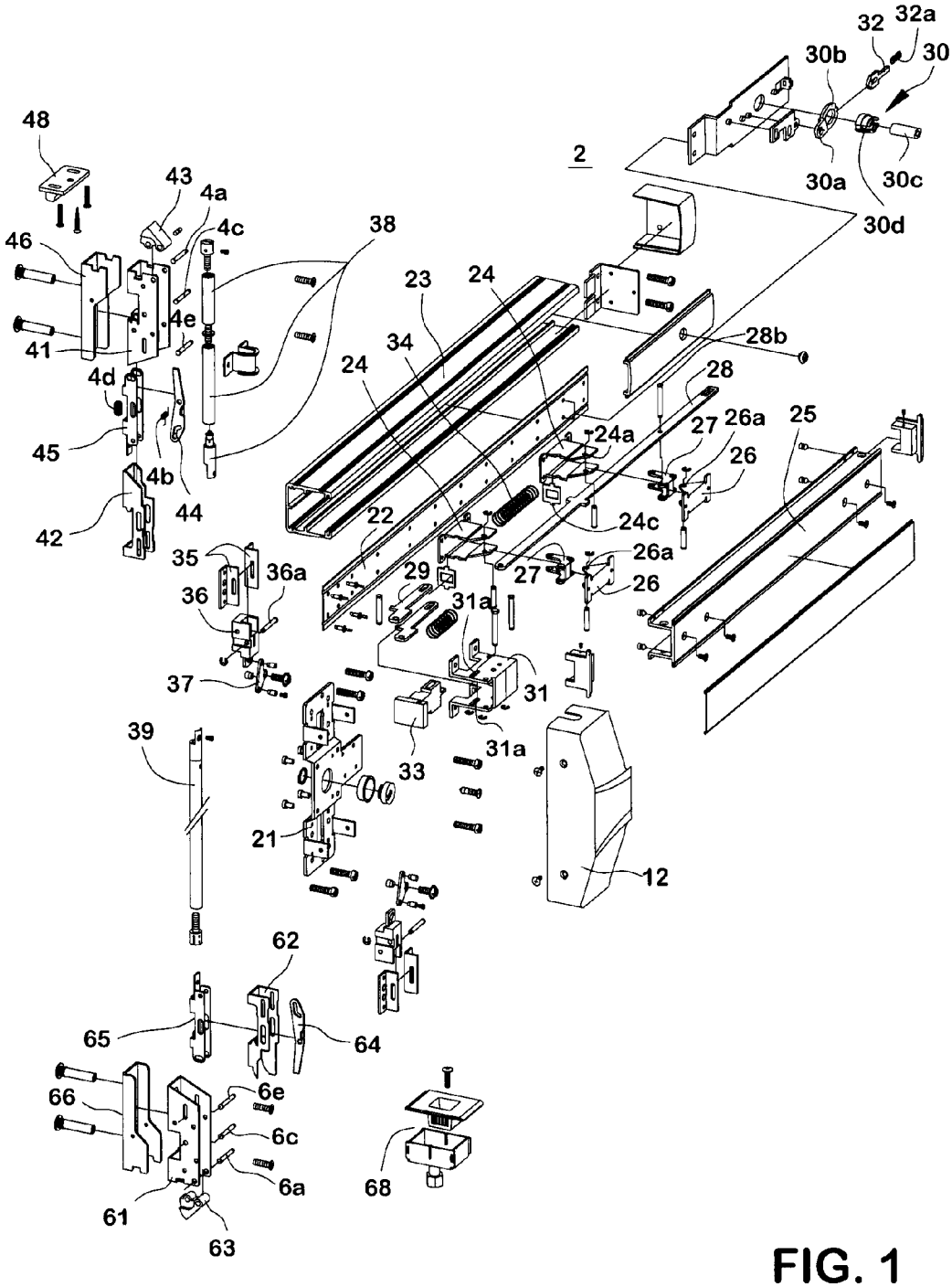
FIG. 1 is an exploded perspective view of an entire fire-blocking door lock according to the present invention.

FIGS. 1 to 12 show preferred embodiments of the fire-blocking door lock structure of the present invention. The present invention enables a fire-blocking door 1 to comprise a frame member 10, a push handle 11, and a casing 12 forming a constituent body mounted on the fire-blocking door plank. The present invention provides a fire-blocking door lock structure 2 for being installed inside the constituent body on the fire-blocking door 1, the casing 12 has the bottom thereof mounted on a base body 21 and connected to a frame plate 22. The fire-blocking door lock structure 2 mainly comprises a middle latch mechanism 3, an upper latch mechanism 4, a lower latch mechanism 6 and an actuation mechanism 9.

The illustrative embodiments of the present invention are described using a fire-blocking door lock mounted on said constituent part. The present invention can be applicable to conventional fire-blocking doors without changing the structure of such kind of fire-blocking door, the embodiments of the following descriptions according to the fire-blocking door lock structure 2 of the present invention shall be based on the fire-blocking door of prior technique as an example for details.

As shown in FIG. 1, the frame member 10 is a frame with a recess portion for a frame plate 22 to be mounted; two lower supports 24 are fixedly secured to both sides of the frame plate 22, respectively, with holes 24*a* set on the top each. The push handle 11 can be pressed down by a user for unlatching the door lock and is installed inside the frame member 10 for being moved upwards and downwards; two upper supports 26 are fixedly secured on both sides of the bottom of the push handle 11, respectively, with holes 26*a* set on the bottom each.

Figure 2:
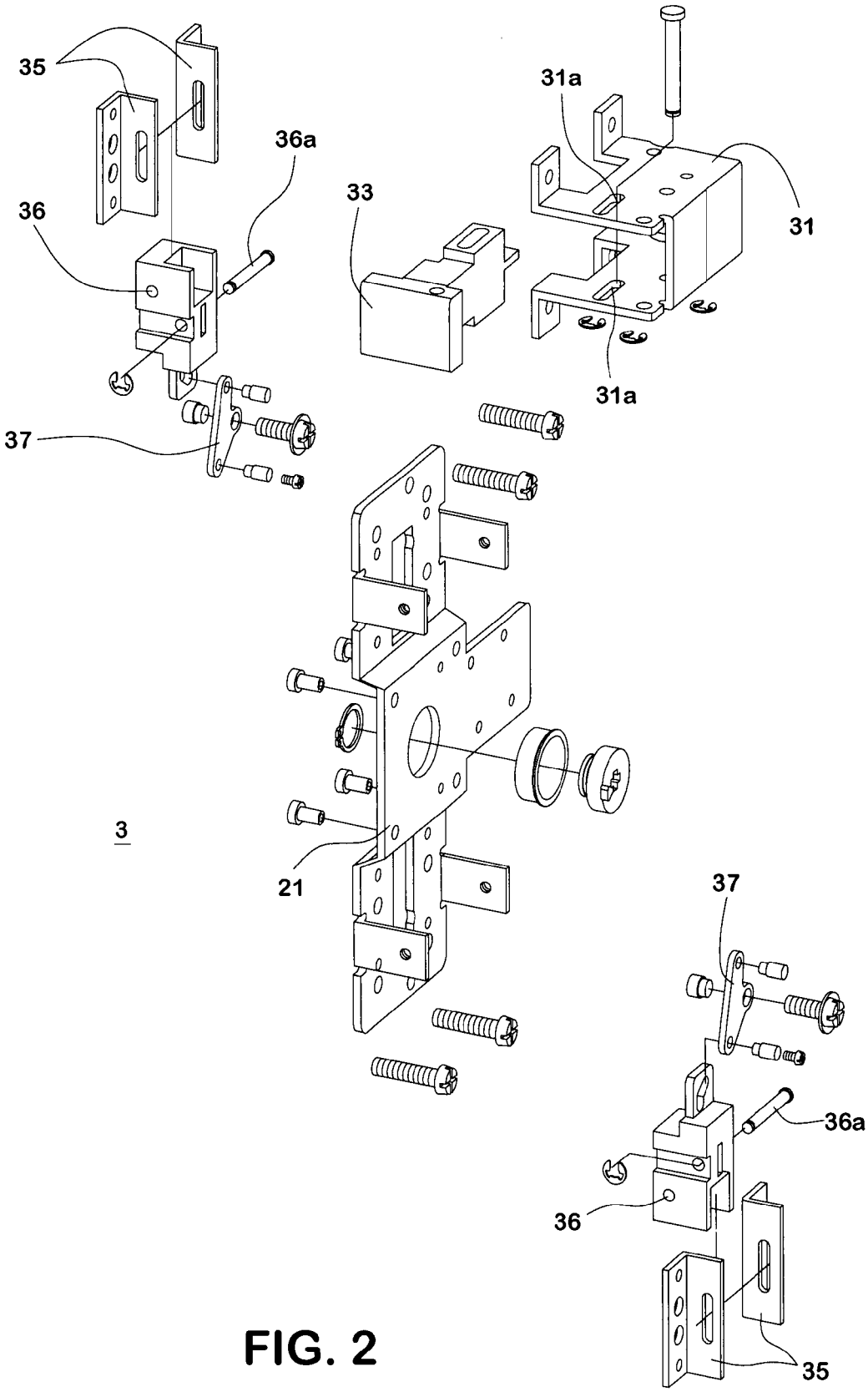
FIG. 2 is an exploded perspective view of a middle latch mechanism of the present invention.
Figure 3:
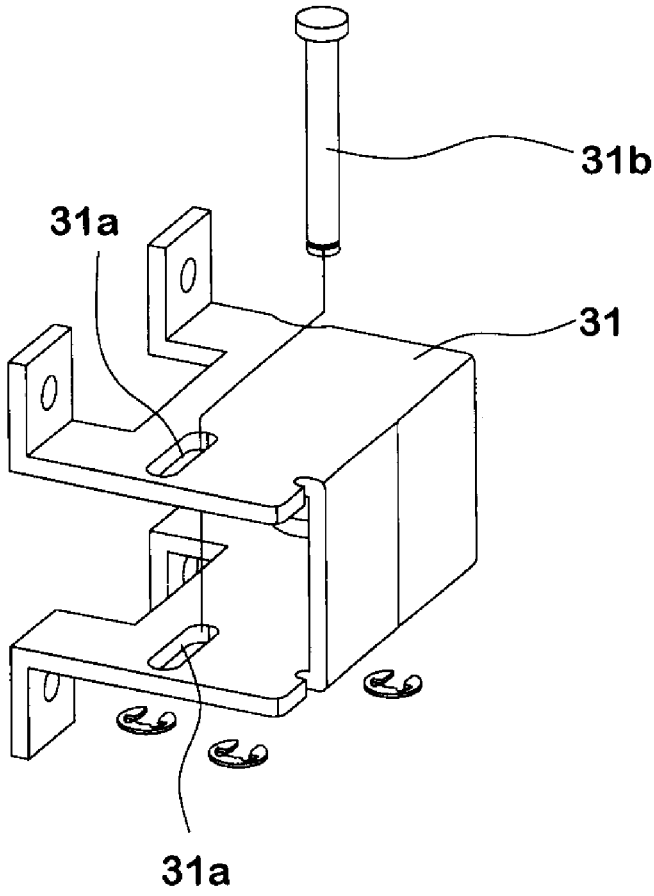
FIG. 3 is a perspective view of the slide support according to the present invention.
Figure 4:
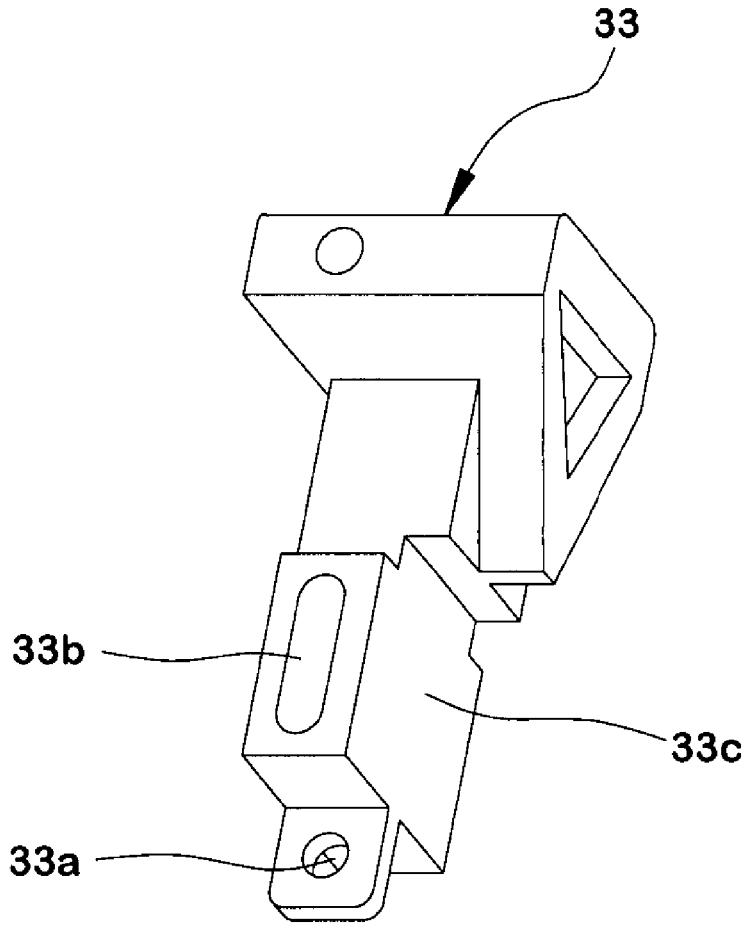
FIG. 4 is a perspective view of the latch block according to the present invention.

As shown in FIGS. 1 and 2, the middle latch mechanism 3 comprises a slide support 31, a latch block 33 pivotally installed and shifted inside the slide support 31, two driving pieces 37, which are separately, smoothly shifted and joined to the slide support 31 and the latch block 33, and two pairs of sliding blocks 36 that can be driven by the driving pieces 37 and pierced through the driving pieces 37 by dint of pins 36*a*. As shown in FIGS. 1 and 3, the slide support 31 is roughly mounted on the center of the base body 21 inside the casing forming holes 31*a* on the front end thereof. As shown in FIGS. 1 and 4, the latch block 33 is connected to the slide support 31 and pierced through by a pin 31*b* to the holes 31*a* at the front end of the slide support 31. The latch block 33 comprises two pivot holes 33*a* formed on the both sides, a hole 33*b* on the top of one side and a recess portion 33*c* formed near the side of the hole 33*b*. The latch block 33 is connected with third corners 37*c* of the driving pieces 37 (described later) by dint of the two pivot holes 33*a*, in addition, connected with linking pieces 29 by dint of the hole 33*b*; the recess portion 33*c* enables the latch block 33 not to be contacted with the casing 12 while the latch block 33 is retracted to the inside and extended outside of the latching supports.

The embodiment illustrates that the latch block 33 pivotally connected to the third corners 37*c* of the driving piece 37 by the holes 33*a* on both sides of the latch block 33 for actuating the driving pieces 37, it is understood that the driving piece 37 can also be driven by other structure forms of the latch block 33, for example, the latch block 33 can has the both lateral sides formed two retaining portions, thereby enabling the third corners 37*c* of the driving pieces 37 to be pivotally shifted and retained inside the latch block 33. Therefore, a latch block can vary without being limited by the embodiment herein.

Figure 5:
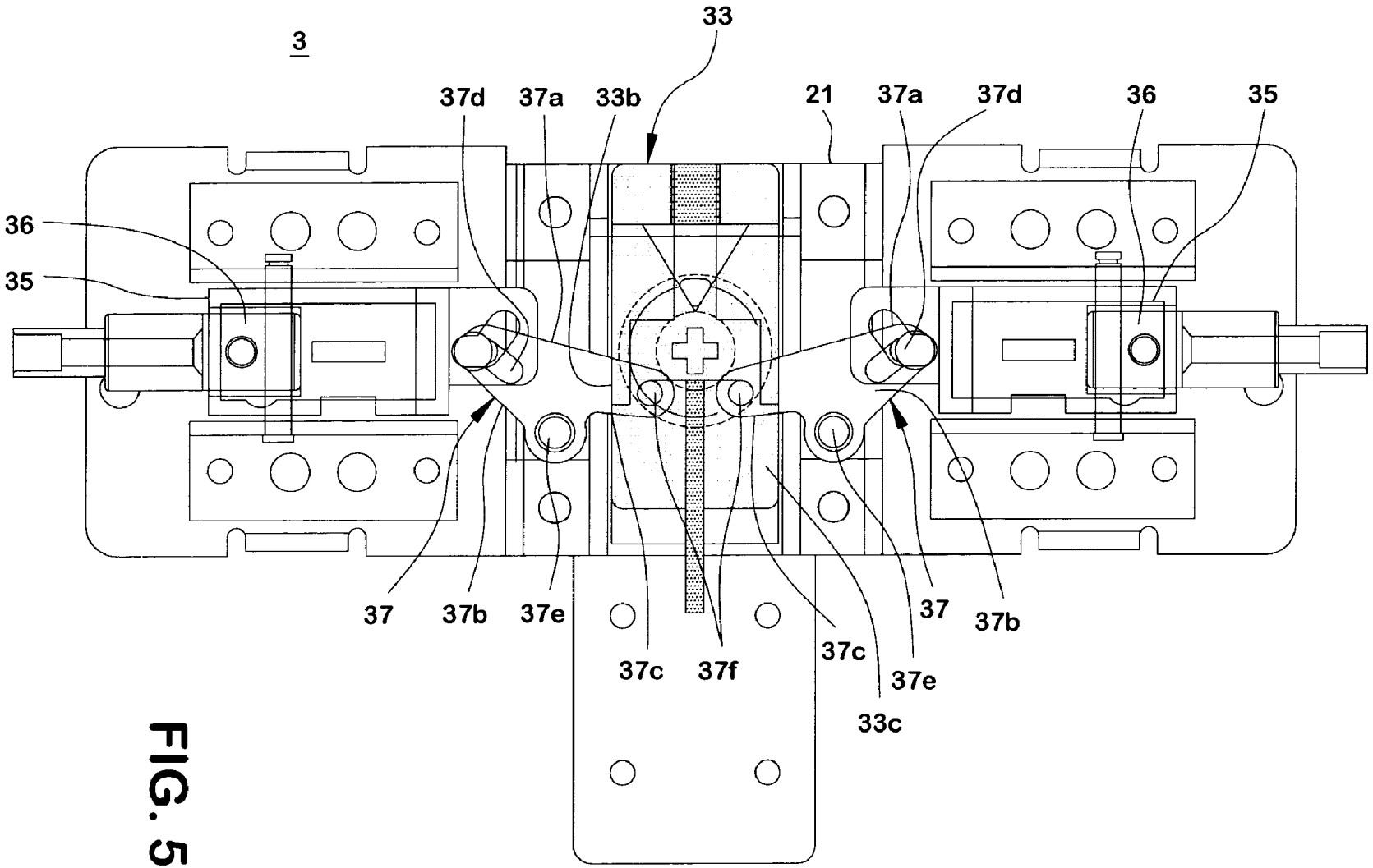
FIG. 5 is a schematic view showing the lockup of the middle latch mechanism according to the present invention.

As shown in FIG. 5, each of the driving pieces 37 is formed to be an L-shape and pivotally installed and shifted on the base body 21 and connected with a sliding block 36. Each of the driving pieces 37 further comprises a first corner 37*a*, a second corner 37*b* and a third corner 37*c*, with holes 37*d*, 37*e* and 37*f* respectively positioned on said corners. The shiftable first corner 37*a* of the driving piece 37 is pivotally connected with the sliding block 36 by dint of the hole 37*d*; the second corner 37*b* is pivotally connected to the slide support 31 by dint of the hole 37*e*; the third corner 37*c* is pivotally connected to the latch block 33 by dint of the hole 37*f*.

The shiftable sliding blocks 36 are respectively and pivotally mounted on sliding block supports 35 positioned on both lateral sides of the base body 21 inside the door latch structure 2. Each of the sliding blocks 36 and each of the sliding block supports 35 are pierced through by a pin 36*a*. Therefore, both of the sliding blocks 36 are respectively positioned inside the pair of the sliding block supports 35, having one sides pivotally connected to the driving pieces 37 and the other sides pivotally connected to pull rods 38 and 39, thereby actuating the pull rods 38 and 39 under the motion of the driving pieces 37. The middle latch mechanism 3 after being assembled is as shown in FIG. 5.

In the embodiment, both of the sliding blocks 36 are respectively positioned in the opposite directions inside the sliding block supports 35 on both lateral sides of the base body 21; however, it should be noticed that such arrangement is merely a illustrative of the present invention herein, the sliding block supports 35 can be integrally formed or in various changes on the base body 21.

Figure 6:
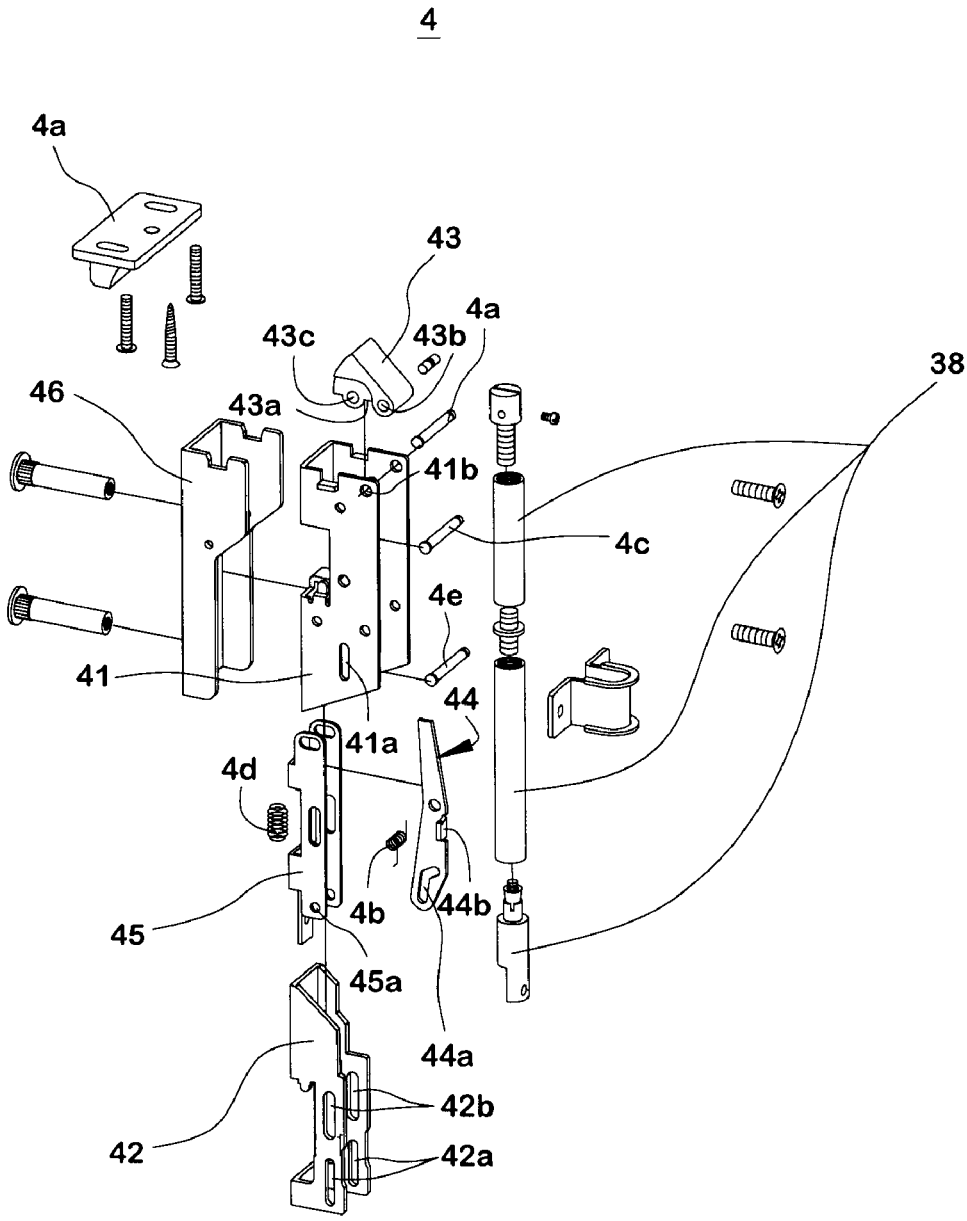
FIG. 6 is an exploded perspective view of the upper latch mechanism according to the present invention.
Figure 7:
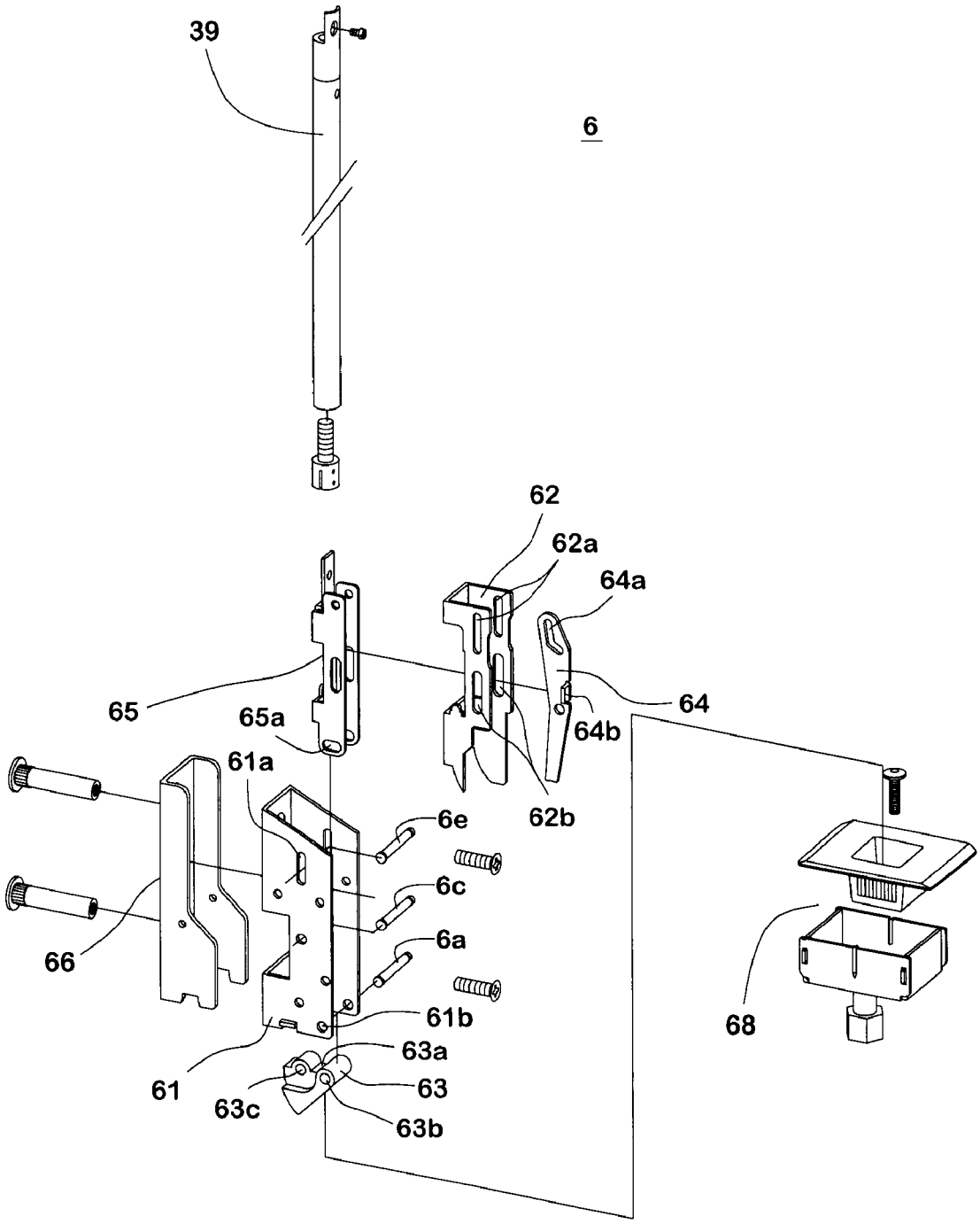
FIG. 7 is an exploded perspective view of the lower latch mechanism according to the present invention.

The upper latch mechanism 4 and the lower latch mechanism 6 are separately positioned on both sides of the middle latch mechanism 3, and respectively connected to the middle latch mechanism 3 on both sides of the base body 21 by the pull rods 38 and 39. As shown in FIGS. 1, 6 and 7, the upper latch mechanism 4 and the lower latch mechanism 6 respectively comprise latching frames 41 and 61, latching supports 42 and 62, latching bodies 43 and 63, stop pieces 44 and 64 and driving pieces 45 and 65. Seeing that the structure of the upper latch mechanism 4 and that of the lower latch mechanism 6 can be identical, therefore, the description in the embodiment mainly focuses on the upper latch mechanism 4.

The latching frames 41 and 61 are frames with recess portions for positioning the latching supports 42 and 62, the latching bodies 43 and 63, the stop pieces 44 and 64 and the driving piece 45 and 65 inside thereof; in addition, the latching frame 41 has guide slot 41*a* and holes 41*b* and 41*c* formed respectively; the latching frame 61 has guide slot 61*a* and holes 61*b*, 61*c* formed respectively. The latching support 42 has guide slots 42*a* and 42*b* formed; the latching support 62 has guide slots 62*a* and 62*b* formed, respectively. The guide slots 42*a* and 62*a* of the latching supports are corresponding to the guide slots 41*a* and 61*a* of the respective latching frames 41 and 61, thereby both of the shiftable latching supports 42 and 62 are separately and shiftably positioned inside the latching frames 41 and 61; the latching bodies 43 and 63, the stop pieces 44 and 64, and the driving pieces 45 and 65 are separately positioned inside the latching supports 42 and 62.

The movable latching bodies 43 and 63 are respectively positioned inside the latching supports 42 and 62 each, in addition, can be retracted to the inside of the latching supports for unlatching the fire-blocking door locks and extended outside of the latching supports for latching the door locks. The latching bodies 43 and 63 separately form stop portions 43*a* and 63*a* and holes 43*b*, 43*c* and 63*b*, 63*c*. The stop portions 43*a* and 63*a* are respectively positioned head-on the stop pieces 44 and 64; first shafts 4*a* and 6*a* are respectively pierced through the holes 41*b* and 61*b* on the latching frames 41 and 61 and the holes 43*b* and 63*b* on the latching bodies 43 and 63. Moreover, there are other shafts (not shown) to be respectively pierced through the holes 41*c* and 61*c* on the latching frame 41 and 61 and the holes 43*c* and 63*c* on the latching bodies 43 and 63, in addition, the drawing does not show shafts pierced through the stop portions 43*a* and 63*a* of the latching bodies 43 and 63. By dint of those shafts, the latching bodies 43 and 63 are secured to the latching frames 41 and 61; consequently, the latching frames 41 and 61 and the latching bodies 43 and 63 can be actuated. Meanwhile, the stop pieces 44 and 64 can be contacted with either the shafts or the stop portions 43*a* and 63*a* of the latching bodies 43 and 63 for retaining both of the latching bodies 43 and 63 outside of the latching supports.

The stop pieces 44 and 64 are further separately formed with guide slots 44*a* and 64*a* and positioning portions 44*b* and 64*b*. The guide slots 44*a* and 64*a* of the stop pieces are formed corresponding to the guide slots 41*a* and 61*a* on the latching frames 41 and 61 and the guide slots 42*a* and 62*a* on the latching supports 42 and 62, thereby the shiftable stop pieces 44 and 64 are separately positioned inside both of the latching frames 41 and 61 and the latching supports 42 and 62. The stop pieces 44 and 64 are urged against the latching bodies 43 and 63, respectively, when there is no external force applied; the angles of the stop pieces 44 and 64 can be changed under an external force. In other words, the stop pieces 44 and 64 can be utilized for retaining part of the stop portions 43*a* and 63*a* of the latching bodies 43 and 63 on the outside of the latching supports 42 and 62, when no any external force is applied; on the contrary, the latching bodies 43 and 63 can be shifted and retracted inside the latching supports 42 and 62, when an external force is applied to release the force of retaining the latching bodies 43 and 63 outside of the latching supports. The latching bodies 43 and 63, therefore, can be retracted inside or extended outside of the latching supports owing to an external force.

The driving pieces 45 and 65 further separately have holes 45*a* and 65*a* positioned corresponding to the guide slots 41*a* and 61*a* of the latching frames 41 and 61, the guide slots 42*a* and 62*a* of the latching supports 42 and 62, and the guide slots 44*a* and 64*a* of the stop pieces 44 and 64. The driving pieces 45 and 65, therefore, enable one ends thereof to be pivotally connected with the latching frames 41 and 61, the latching supports 42 and 62 and the stop pieces 44 and 64, separately; in addition, the driving pieces 45 can optionally be connected to the positioning portion 44*b* of the stop piece 44 by dint of at least one first spiral spring 4*b*, which enables the stop piece 44 to be retained at a fixed position (i.e., securely urged against the position of the latching bodies 43) when no any external force is applied.

In other words, the stop piece 44 can be utilized for retaining the latching body 43 at a position, thereby part of the latching body 43 can be extended outside of the latching support 42; on the contrary, the latching body 43 can be retracted inside of the latching support 42 and the force of retaining the latching body 43 is released, when an external force is applied.

Meanwhile, the driving pieces 45 and 65 have the other sides thereof connected with the pull rods 38 and 39 each, thereby the stop pieces 44 and 64 can be shifted by an applied force from the pull rods 38 and 39.

Figure 8:
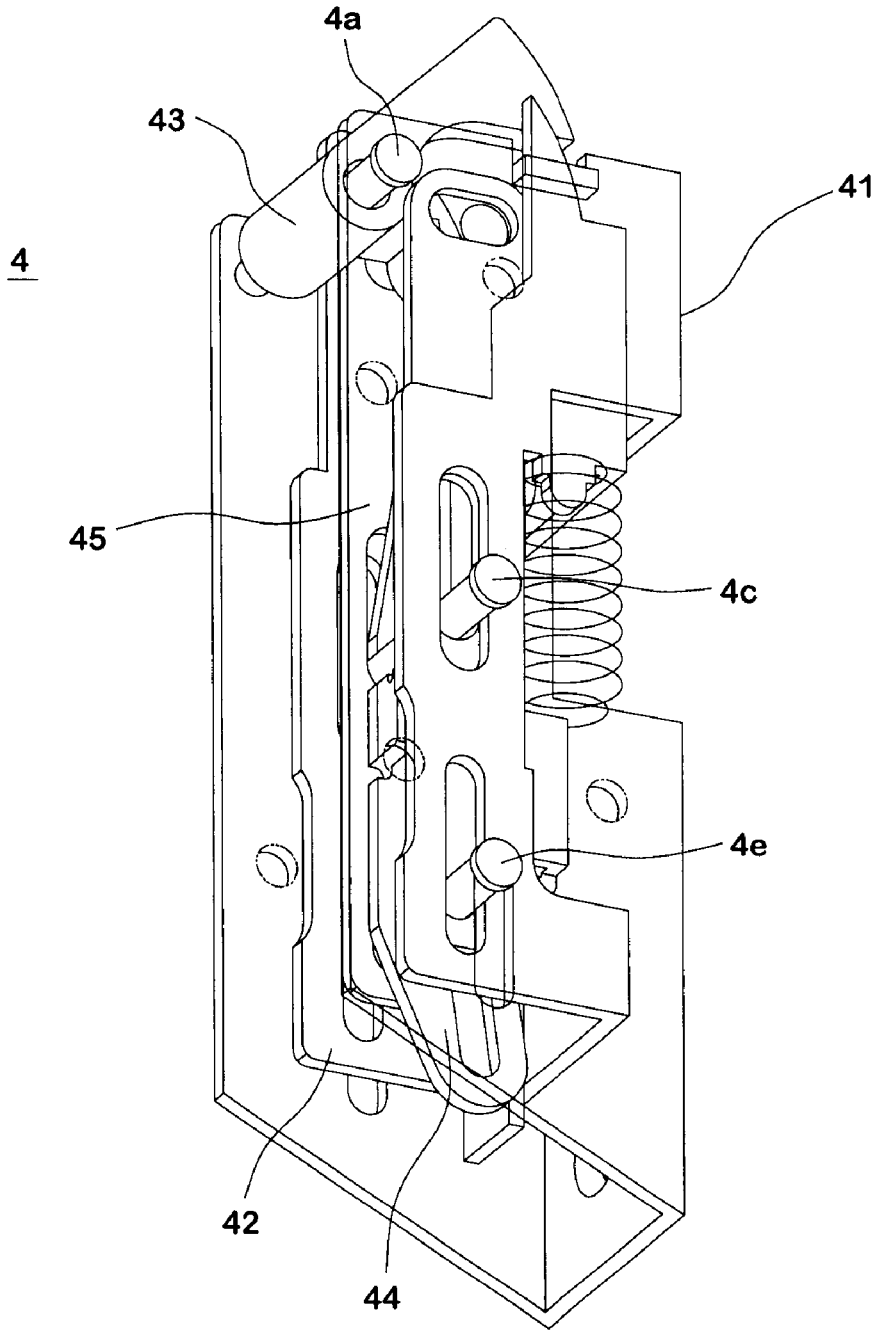
FIG. 8 is a semi-recumbent position of the upper latch mechanism.

The embodiment illustrates that the latching frames 41 and 61, the latching supports 42 and 62 and the driving pieces 45 and 65 have their one ends separately and pivotally connected with the stop pieces 44 and 64 by second shafts 4*c* and 6*c*, in addition, have the other ends pivotally connected to and respectively pierced through the pull rods 38 and 39 by dint of third shafts 4*e* and 6*e*; thereby the latching supports 42 and 62, the stop pieces 44 and 64 and the driving pieces 45 and 65 are simultaneously actuated. The assembled upper latch mechanism 4 is shown in FIG. 8.

At least a second spiral spring 4*d* can be selectively positioned between the latching frame 41 and the driving piece 45. The second spiral spring 4*d* is not compressed, when the driving pieces 45 and 65 are not pulled by the pull rods 38 and 39; on the contrary, the second spiral spring 4*d* is compressed when an external force is applied and the driving pieces 45 and 65 are pulled by the pull rods 38 and 39. When the pull force from the pull rods 38 and 39 is released, the latching supports 42 and 62, the latching bodies 43 and 63, the stop pieces 44 and 64 and the driving pieces 45 and 65 can be restored to their original positions owing to an elastic force from the spiral spring.

The embodiment merely illustrates that the driving piece 45 and the stop piece 44 are connected by the first spiral spring 4*b* and the latching frame 41 and the stop piece 44 are connected by the second spiral spring 4*d*. However, seeing that the upper latch mechanism 4 and the lower latch mechanism 6 are actuated together, the first spiral spring 4*b* and the second spiral spring 4*d* in the embodiment can be positioned at either one of the upper latch mechanism 4 or the lower latch mechanism 6 under actual practice. The invention further enables another first spiral spring 4*b* to connect the driving piece 65 and the positioning portion 64*b* of the stop piece 64, or enables a plurality of second spiral springs 4*d* to be positioned according to the requirement. It should be understood that the simplified structure in the embodiment is merely an illustration, not subject to the limits or restrictions of the invention.

The pull rods 38 and 39 further respectively comprise connecting units 38*a* and 39*a*, both of which can optionally be pierced through by the third shafts 4*e* and 6*e*, thereby separately and pivotally connected with one ends of the latching frames 41 and 61, the latching supports 42 and 62, the driving pieces 45 and 65 and the pull rods 38 and 39. The pull rods 38 and 39 in the embodiment merely illustrate round-shaped rods, however, it should be understood that the shapes and the lengths of the pull rods 38 and 39 are not subject to be limited by the embodiment herein, and the shapes and the lengths of the connecting units 38*a* and 39*a* also can be changed according to actual requirements.

Figure 9:
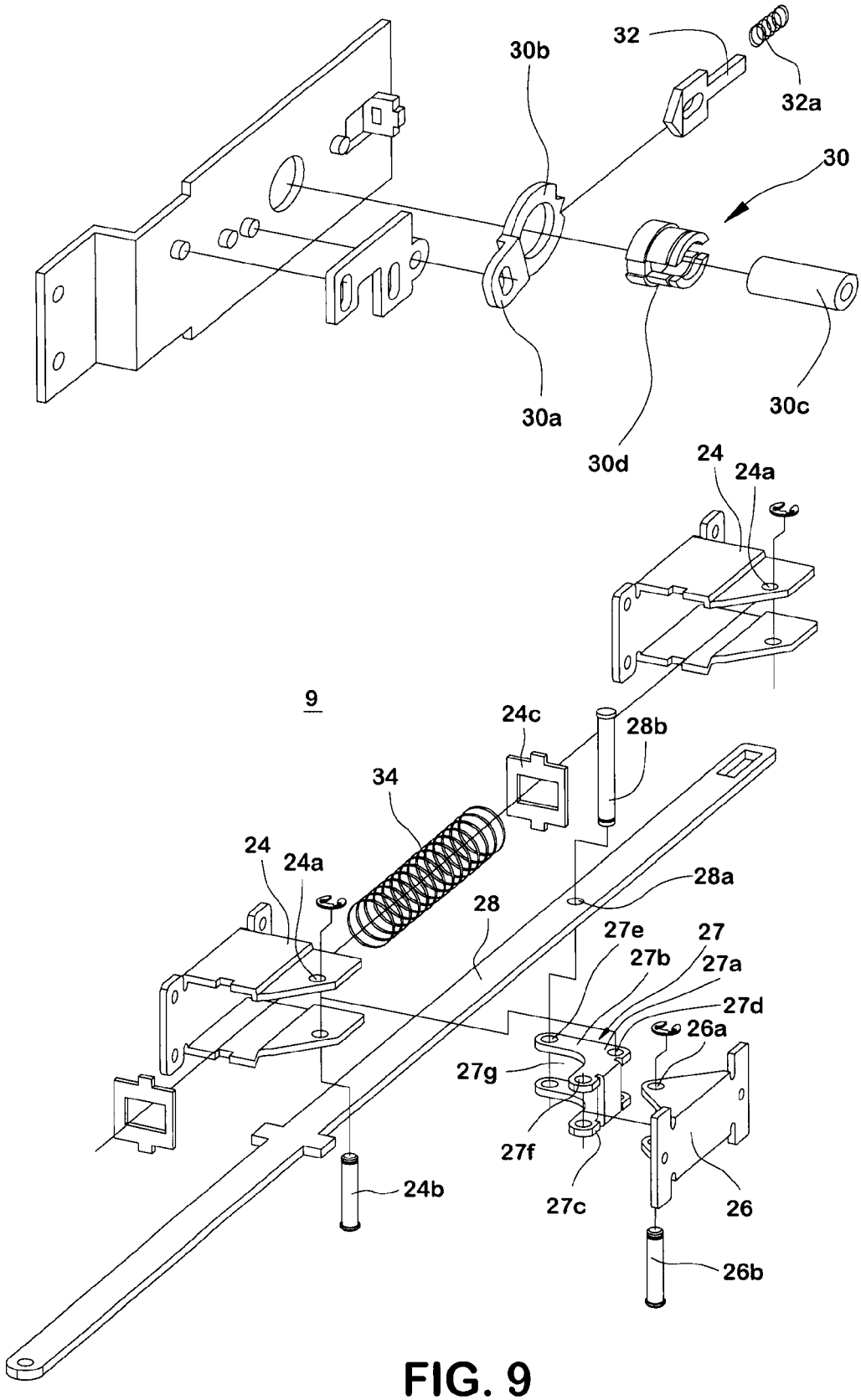
FIG. 9 is an exploded perspective view of the actuation mechanism of the present invention.

As shown in FIGS.1 and 9, the actuation mechanism 9 is positioned inside the frame member 10 and connected with the latch block 33 of the middle latch mechanism 3 by the linking pieces 29. The actuation mechanism comprises two revolving pieces 27 and a draft bar 28. The revolving pieces 27 are pivotally secured to the inside of the push handle 11 formed to be an L-shape each and connected to the lower support 24. The revolving pieces 27 further comprises first corners 27*a*, second corners 27*b* and third corners 27*c* with holes 27*d*, 27*e* and 27*f* respectively positioned whereon. The embodiment merely illustrates two revolving pieces 27 in the actuation mechanism 9; however, it is understood that one or more than two revolving pieces 27 can be applied to the invention, and the shapes of the revolving pieces 27 can vary according to the requirements.

The draft bar 28 is fixedly secured to one end of the revolving pieces 27 formed as a strip shape. The draft bar 28 has both sides thereof pivotally secured on the second corners 27*b* by a pin 28*b* respectively pierced through the holes 27*e*. Moreover, the draft bar 28 has one end thereof pivotally connected to the linking pieces 29 for generating a parallel pull force owing to the actuation of the draft bar 28 and transmitting such force to the latch block 33 of the middle latch mechanism 3.

The draft bar 28 has one end away from the middle latch mechanism 3 connected a pivot joint member 30, which is shiftably positioned inside a draft stand 28*d* and pivotally connected to the draft bar 28. The pivot joint member 30 comprises a first pivot joint 30*a*, which can be shiftably and pivotally connected to the draft stand 28*d*, and a second pivot joint 30*b*, which can be shiftably and pivotally connected to a driving piece 32 sleeving a spring 32*a*. An operating piece 30*c* (such as a latch) coaxial to the pivot joint member 30 is engaged with both of the first pivot joint 30*a* and the second pivot joint 30. A retaining piece 30*d* is utilized for axially retaining parallel extension of both of the operating piece 30*c* and the first pivot joint 30*a*. The first pivot joint 30*a* is pivoted on the draft bar 28 and shifted between a first position and a second position of the draft bar 28. The first position of the draft bar 28 is a position for engaging the operating piece 30*c* and opening the operating piece 30*c*; where the second position of the draft bar 28 is a position for disengaging the operating piece 30*c* and opening operating piece 30*c*. The second pivot joint 30*b* can be biased with the first pivot joint 30*a* at any position of either the first position or the second position by dint of the spring 32*a* in the driving piece 32, thereby generating the adjustably effects on the pivot joint member 30 in several phases for latching and unlatching the door locks.

The pivot joint member 30, the operating piece 30*c*, the retaining piece 30*d*, the driving piece 32 and the spring 32*a* in the embodiment are applied to a fire-blocking door lock structure with hidden hinges on the top and bottom thereof; however, it should be understood that the components are not subject to be limited by the embodiment herein, but applicable to other kinds of fire-blocking door locks.

The pivot joint member 30 of the invention can be utilized for resolving a conventional door lock problem that the hook portion of the holdfast member 12*p* is easily departed from the original position owing to a strike or damage by intention. In addition, the invention can help to improve another drawback in prior technique that the clamp 12*q* can not be appropriately biased with and retained by the spring 12*s*. The pivot joint member 30 of the invention can not only ensure the efficacy of the operating piece 30*c* of a latch piece, but also be biased with the first pivot joint 30*a* at any position of either the first position or the second position, thereby ensuring both of the operating piece 30*c* and the first pivot joint 30*a* to be precisely actuated and adjusted in phases.

The push handle 11 has both inner ends thereof secured upper supports 26, which has the bottom sides thereof positioned holes 26*a*, which are connected and secured to the holes 27*f* at the third corner 27*c* by piercing through the pin 26*b*, thereby the revolving pieces 27 are pivoted on the pin 26*b* and swung inside the upper support 26. In addition, the revolving pieces 27 form hollow portions 27*g* each for the strip-piece draft bar 28 to be pierced through. Moreover, a pin 24*b* is utilized for piercing through the holes 27*d* at the first corner 27*a* and the holes 24*a*, thereby connecting to the top of the lower support 24; in addition, a pin 28*b* is utilized for piercing through the holes 27*e* at the second corner 27*b* and the hole 28*a* for connecting to the draft bar 28.

When the push handle 11 is pressed down by a user for unlatching the door lock through the actuation mechanism 9, the draft bar 28 is driven by the revolving pieces 27 under a downward force and extended to the direction away from the middle latch mechanism 3. Subsequently, the latch block 33 is driven by the draft bar 28 and a horizontal pull force, which is passed down to the driving piece 37 of the middle latch mechanism 3, is generated for actuating the sliding block 36, which is connected to the driving piece 37 and the pull rods 38 and 39. Consequently, the pull rods 38 and 39 respectively use the connecting units 38*a* and 39*a* thereof for actuating the latching supports 42 and 62 and driving pieces 45 and 65 inside the upper latch mechanism 4 and the lower latch mechanism 6 respective, and enabling the driving pieces 45 and 65 to change the positions of the stop pieces 44 and 64 in order to simultaneously drive the latching bodies 43 and 63 to be retracted inside the latching frames 41 and 61. Therefore, by dint of actuating the middle latch mechanism 3, the pull rods 38 and 39 are driven to enable the upper latch mechanism 4 and the lower latch mechanism 6 to be simultaneously actuated; thereupon all constituent parts are carried out the motion of unlatching the door lock.

When the pressure of pressing down the push handle 11 and actuating the actuation mechanism 9 is released, the draft bar 28 of the actuation mechanism 9 is restored to the original latched position; consequently, the force of driving the linking pieces 29 and the pull rods 38 and 39 is disappeared, thereby the latch block 33 is disengaged from the force passed from the linking pieces 29 and can be restored back to the original position when the pull force of the pull rods 38 and 39 is released. Subsequently, the latching supports 42 and 62 and the driving pieces 45 and 65 can be restored to the original positions by an elastic power that is a compressed force of the second spiral spring 4*d* generated when the lock is unlatched. Moreover, the stop pieces 44 and 64 are restored back to the original positions by the second spiral spring 4*b* and another second spiral spring (not shown), which are positioned between the driving pieces 45 and 65 and the stop pieces 44 and 64. Thus, the stop pieces 44 and 64 are urged against the latching bodies 43 and 63, which are surely restored to and retained on the positions outside the latching member; thereupon the upper latch mechanism 4 and lower latch mechanism 6 are simultaneously carried out the motion of latching the door lock.

The aforementioned components on the middle latch mechanism 3, the upper latch mechanism 4, the lower latch mechanism and the actuation mechanism 9 can be modularized in order to save the maintenance cost, thereby any parts and components can be easily replaced in the event of breakdowns.

In view of the foregoing, the middle latch mechanism 3, the upper latch mechanism 4 and the lower latch mechanism can be selectively mounted on the casing 12 and fixed support covers 48 and 68 can be selectively mounted on both sides of the casing 12, thereby the middle latch mechanism 3, the upper latch mechanism 4 and the lower latch mechanism 6 are securely mounted on the casing 12 with appropriate protection. Moreover, it should be understood that the fixed support covers 48 and 68 are not subject to be limited by the embodiment and its drawings herein; any kind of covers that can ensure the middle latch mechanism 3, the upper latch mechanism 4 and the lower latch mechanism 6 to be protected inside the casing 12 can be applicable.

Therefore, the present invention enables fire-blocking door locks to be easily actuated, moreover, enables the middle latch mechanism 3, the upper latch mechanism 4 and the lower latch mechanism 6 inside the fire-blocking door lock structure 2 to be securely fixed with appropriate protection. The invention can resolve the prior technique problem of a fire-blocking door lock structure that the fire-blocking door lock can not be truly latched after being struck and damaged by intention, further improving the efficacy of using such a fire-blocking door lock.

Figure 10:
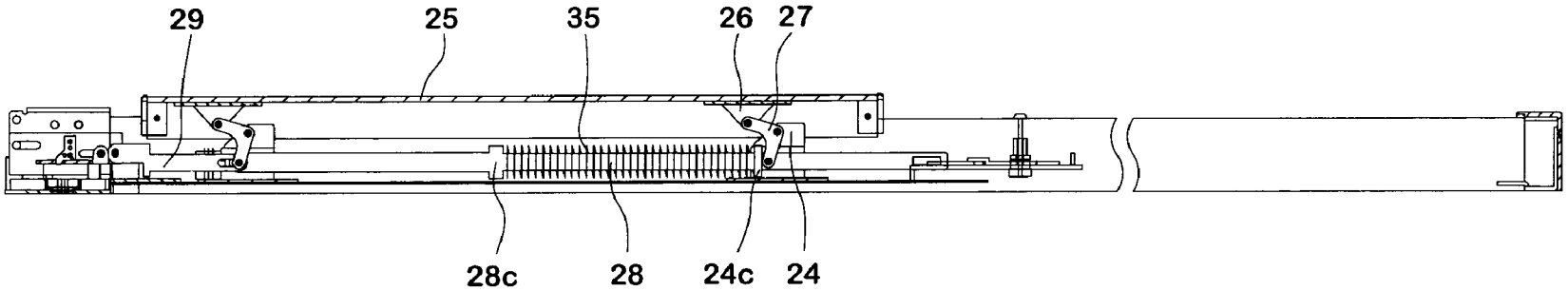
FIG. 10 is a perspective view showing the lockup of the actuation mechanism according to the present invention.
Figure 12:
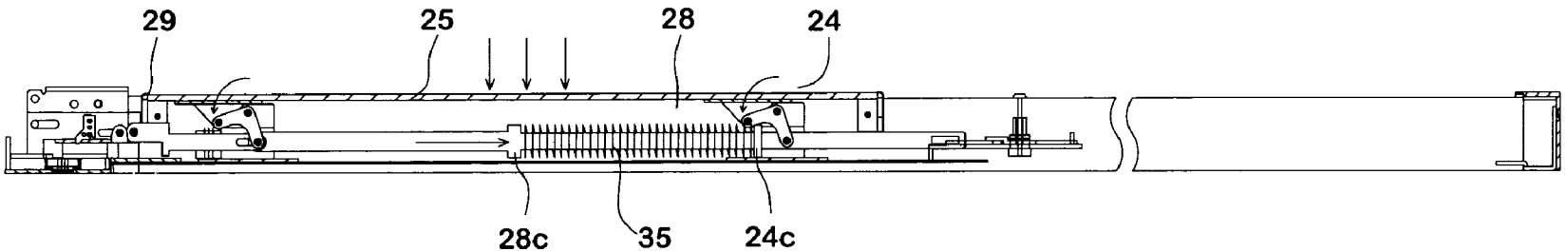
FIG. 12 is a perspective view of the unlatch condition of the actuation mechanism according to the present invention.
Figure 11:
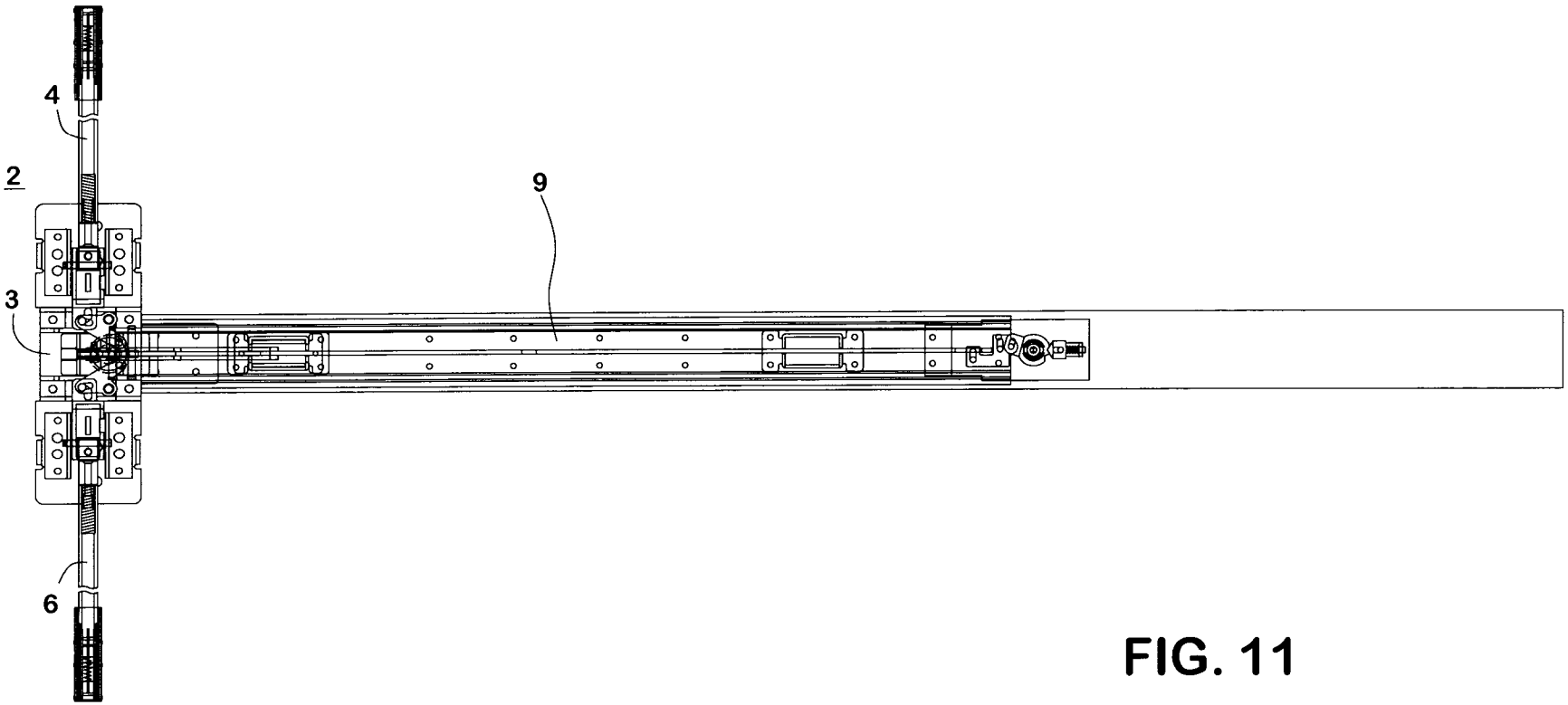
FIG. 11 is a perspective view showing the unlatch condition of the fire-blocking door lock structure of the present invention.
Figure 11A:
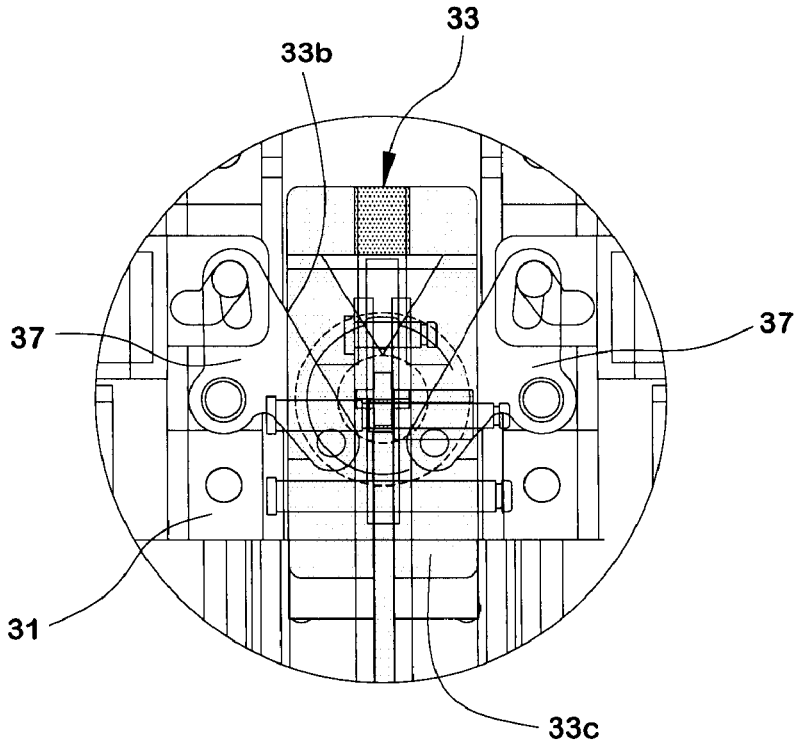
FIG. 11A is an enlarged view of a portion of FIG. 11 showing a part of the middle latch mechanism of the present invention.
Figure 11B:
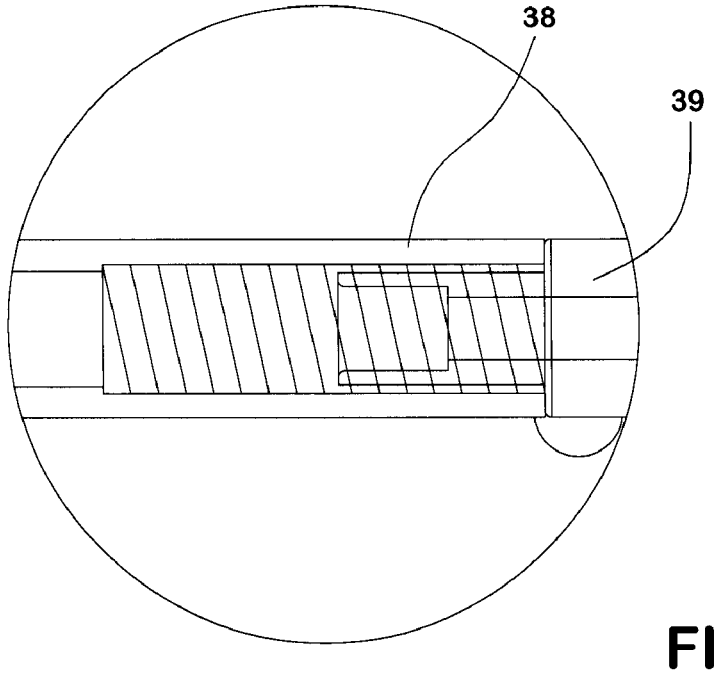
FIG. 11B is an enlarged view of a portion of FIG. 11 showing a part of the fire-blocking door lock structure of the present invention.
Figure 11C:
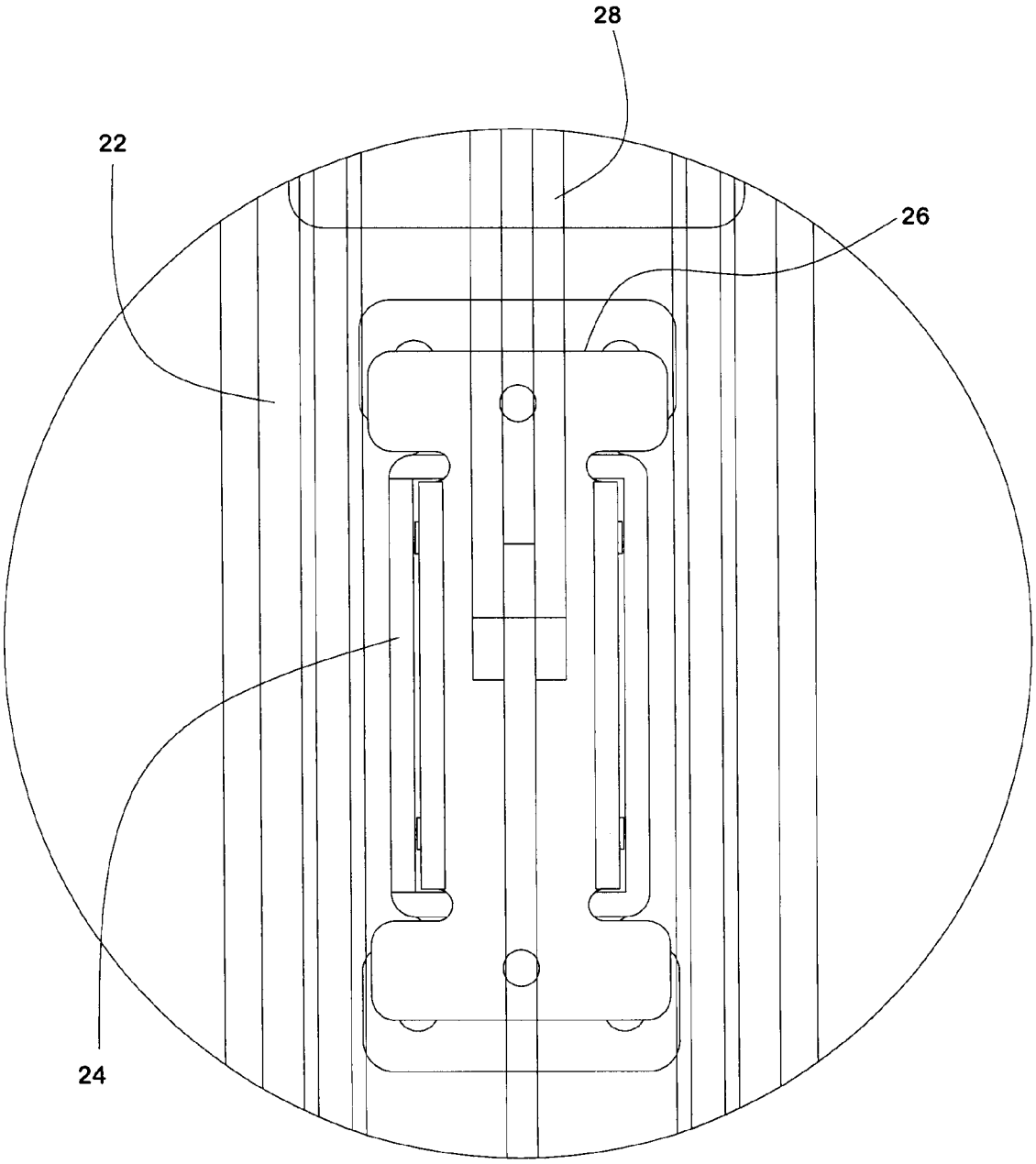
FIG. 11C is an enlarged view of a portion of FIG. 11 showing a part of the actuation mechanism of the present invention.
Figure 11D:
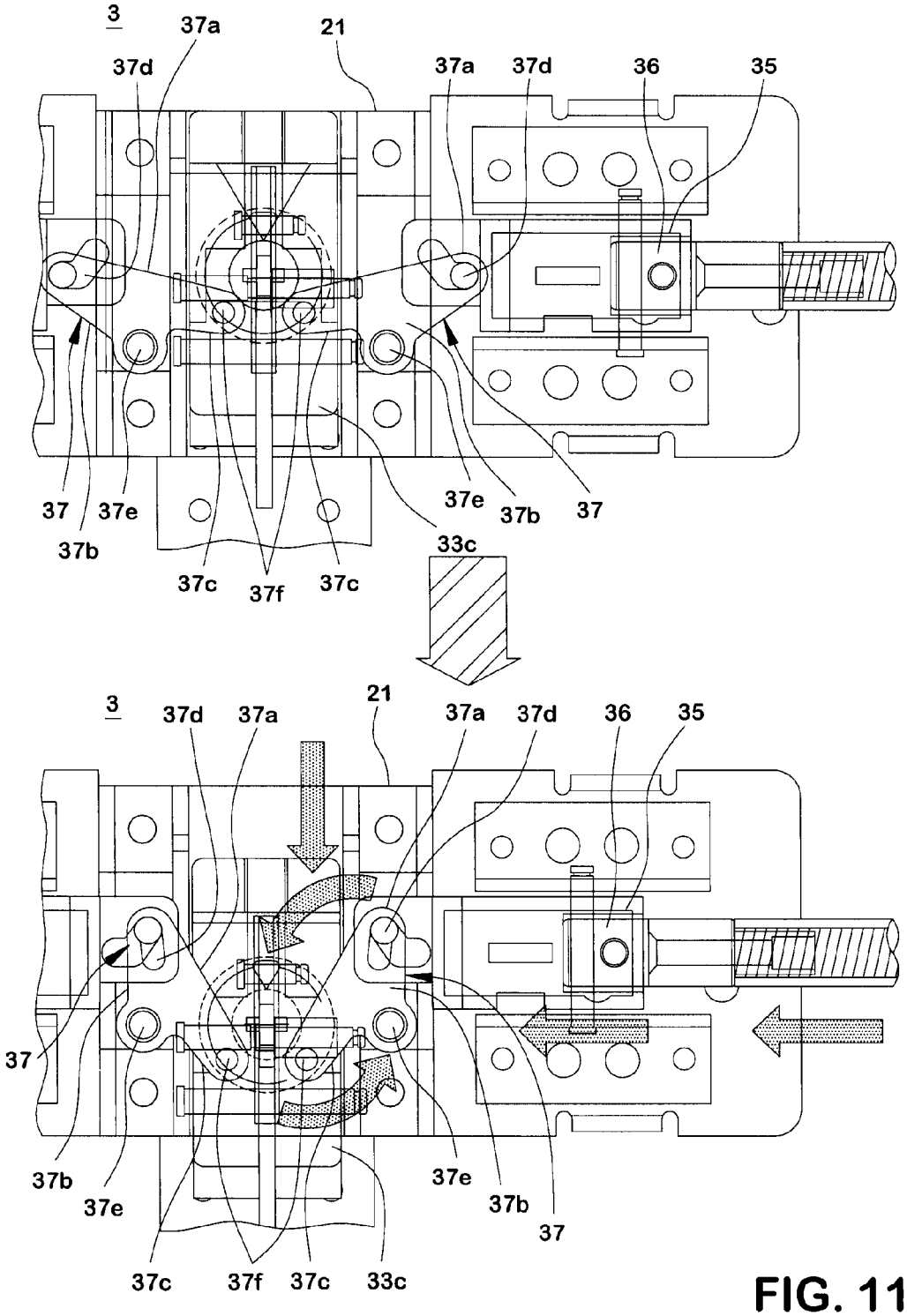
FIG. 11D is a schematic view showing the connection of the components of the middle latch mechanism according to the present invention.
Figure 11E:
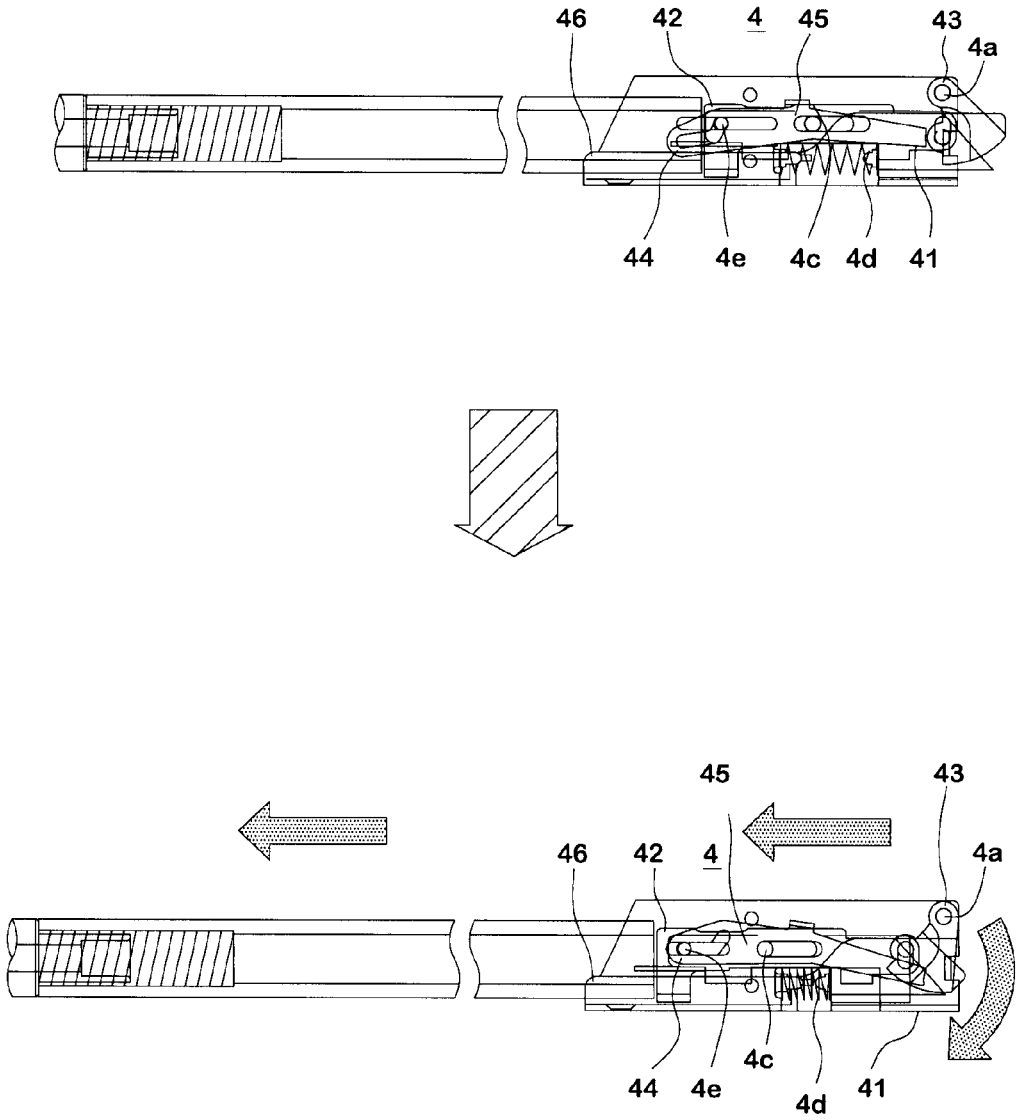
FIG. 11E is a perspective view showing the connection of the components of the upper latch mechanism according to the present invention.
Figure 11F:
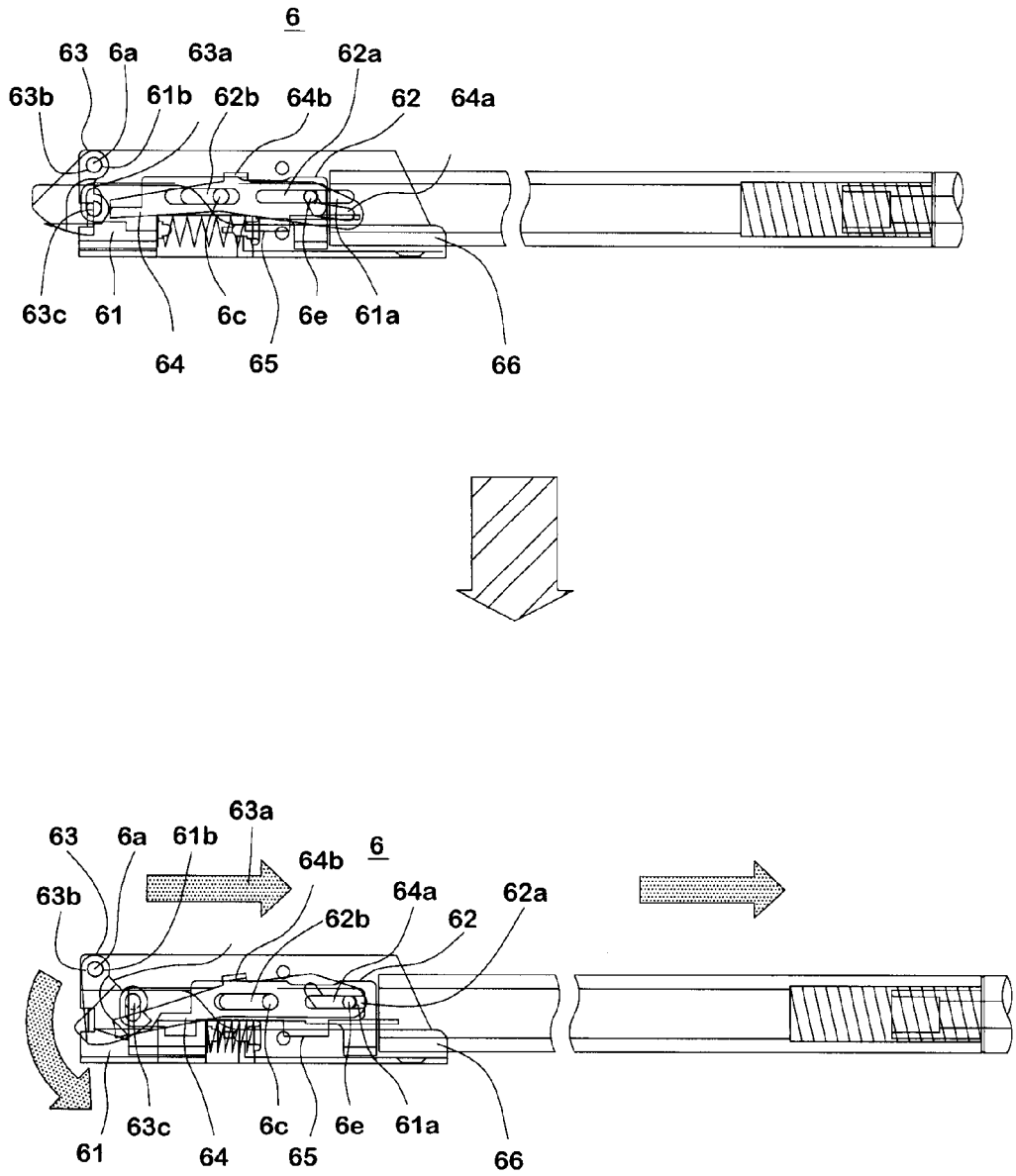
FIG. 11F is a perspective view showing the connection of the components of the lower latch mechanism according to the present invention.
Figure 13:
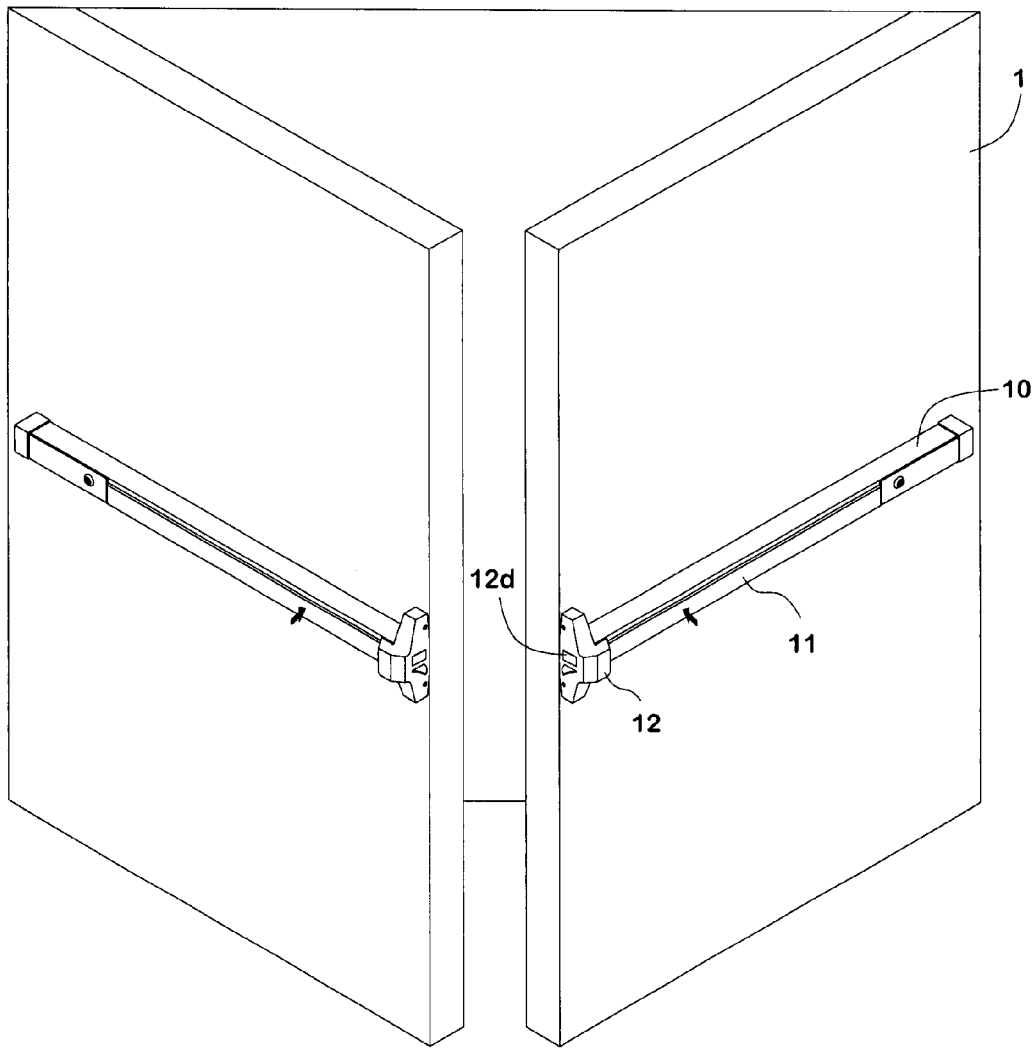
FIG. 13 (PRIOR ART)
FIG. 13 (prior art) is a perspective view showing a conventional fire-blocking door and its fire-blocking door lock structure.
Figure 14:
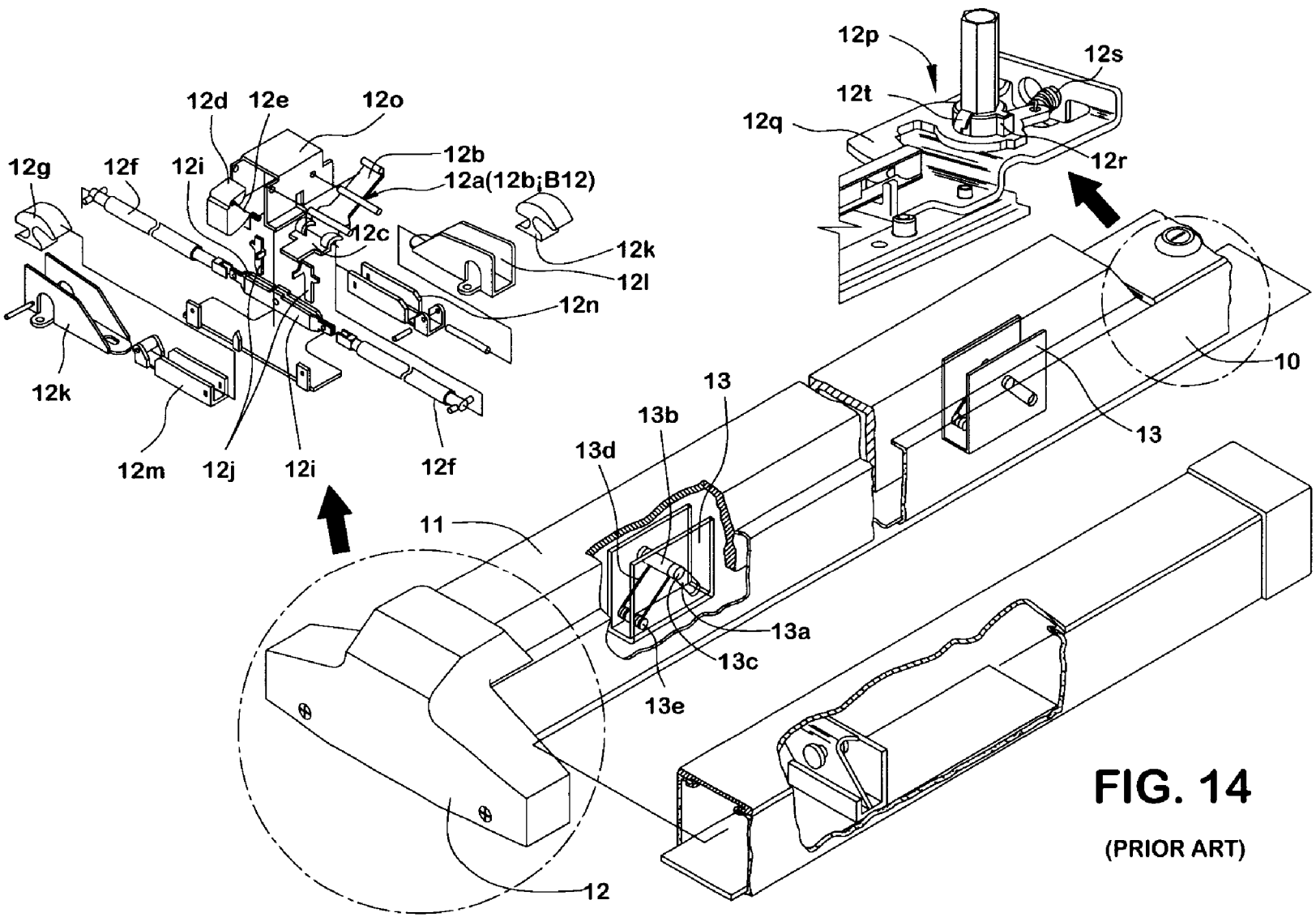
FIG. 14 (PRIOR ART)
FIG. 14 (prior art) is an assembled perspective view of a conventional fire-blocking door lock structure.

As shown in FIGS. 5 and 10, the fire-blocking door lock is latched when no an external force is applied to the push handle 11. According to FIGS. 11 and 12, the upper support 26 is moved downwards (following the direction of arrow points) when an external force is applied to the push handle 11, thereby the second corners 27 on the revolving pieces 27 are simultaneously driven to move downwards and the third corners 27*c* on the revolving pieces 27 are pivoted on the pin 24*b* inside the holes 24*a* of the lower support 24 for swinging, thereby the draft bar 28 connected to the revolving pieces 27 is horizontally moved towards the swinging direction, thereby the linking pieces 29 and the slide support 31 on the front end of the draft bar 28 are simultaneously and in parallel moved backwards, thereby the latch block 33 positioned inside the slide support 31 is then driven by the linking pieces 29 and swung backwards and retracted back inside of the slide support 31.

Seeing that the latch block 33 is pivotally connected to the third corners 37*c* on the driving piece 37, therefore, the force driving the latch block 33 swung backwards and retracted inside the slide support 31 then actuates the driving piece 37, the sliding block 36 connected to the driving piece 37 and the pull rods 38 and 39*c* connected to the sliding block 36; thereby the driving pieces 45 and 65 inside the upper latch mechanism 4 and the lower latch mechanism 6 are simultaneously actuated. The driving pieces 45 and 65 are moved owing to the force, thereby the first spiral spring 4*b* connected to the stop piece 44 is forced to actuate the stop piece 44, which is then changed from the original angle under such force (i.e., the angle urging against the latching body 43) to another angle without urging against the latching body 43.

Therefore, the force coming from the pull rods 38 and 39 can simultaneously actuate the driving pieces 45 and 65 and the stop pieces 44 and 64, thereby the stop pieces 44 and 64 are unable to urge against the latching bodies 43 and 63, thereby the driving pieces 45 and 65 are forced to drive the latching bodies 43 and 63 move towards the direction of the middle latch mechanism, thereby the latching bodies 43 and 63 are retracted back to their original positions for unlatching the door lock.

According to the said mechanisms of the fire-blocking door lock of the present invention, the invention enables the user to save strength and easily unlatch the fire-blocking door lock when a user perpendicularly presses down the push handle 11.

The draft bar 28 has the central portion thereof formed a stop portion 28*c* protruding out for sleeving and positioning one end of a locking spring 34, in addition, the locking spring 34 has the other end thereof positioned inside an arresting piece 24*c* of the lower support 24. Therefore, when the user releases the physical force on the push handle 11, the restoring force from the locking spring 34 after being compressed enables the draft bar 28 to horizontally move back to the original position (as shown in the arrow direction), thereby the linking pieces 29 on the front end of the draft bar 28 and the slide support 31 are simultaneously and horizontally moved forwards. Consequently, the latch block 33 positioned inside the slide support 31 is driven by the slide support 31 and swung forwards, the latch block 33 then is forced to drive the middle latch mechanism 3, the latching bodies 43 and 63 inside the upper latch mechanism 4 and lower latch mechanism 6 are driven by the pull rods 38 and 39 and extended to the position outside the latch frame for latching the door.

The characteristic of the fire-blocking door lock structure 2 of the present invention lies in that the latch block 33 of the middle latch mechanism 3 can be shiftably actuated the press force from the actuation mechanism 9 to both of the upper latch mechanism 4 and the lower latch mechanism 6, the driving pieces 45 and 65 inside the upper latch mechanism 4 and the lower latch mechanism 6 are under the force from the middle latch mechanism 3, thereby the latching bodies 43 and 63 are simultaneously actuated to shift between the positions of being retracted inside and being extended outside the latch mechanisms. The present invention resolves a conventional problem by simplifying the structures of the middle latch mechanism 3, the upper latch mechanism 4, the lower latch mechanism 6 and the actuation mechanism 9, enabling all kinds of parts to be securely coupled, thereby the assembly process can be shorten and the manufacturing cost of making various components is reduced. The invention, therefore, is favorable for the assembly and manufacturing of the fire-blocking door lock structure.

Meanwhile, since the fire-blocking door lock structure of the present invention is simplified and the actuation of latching and unlatching the door lock is powerful, the invention resolves a conventional door lock technique drawback of applying a greater force to actuate all components of a door lock; in addition, the invention ensures all components to be jointly actuated for achieving the objectives of latching or unlatching the door lock.

Moreover, the fire-blocking door lock structure of the present invention enables all components and parts to be modularized, thereby damaged parts can be easily dismantled from such a simplified door lock structure. The invention, therefore, provides a fire-blocking door lock structure that can be easily maintained and used longer without a conventional complicated door lock drawback of failing to dismantle components of a door lock for replacement.

In view of the foregoing, the fire-blocking door lock structure of the present invention is used for resolving various problems of a conventional fire-blocking door lock structure by simplifying the door lock structure, modularizing all kinds of components for easily being assembled and manufactured, enabling a user to easily opening the fire-blocking door without applying extra strength, and enabling the modularized components to be easily maintained and the lifespan of components to be prolonged, thus, the invention assures the efficacy of securely using the fire-blocking door lock.

The invention has been described using exemplary preferred embodiments. However, it is to be understood that the scope of the invention is not limited to the disclosed embodiments. On the contrary, it is intended to cover various modifications and similar arrangements, for example changing the shapes of the upper and the lower supports, or the spring position on the draft bar, etc. The scope of the claims, therefore, should be accorded the broadest interpretation so as to encompass all such modifications and similar arrangements.

What is claimed is:

1. A fire-blocking door lock structure mounted on a fire-blocking door comprising a frame member, a push handle and a casing, the casing fixed to a plate member and connected to a base body, the fire-blocking door lock structure comprising:

a middle latch mechanism mounted in the casing;

an upper latch mechanism and a lower latch mechanism symmetrically mounted on opposite sides of the middle latch mechanism and connected to the middle latch mechanism; and an actuation mechanism connected to the middle latch mechanism, comprising at least one revolving piece and a draft bar, wherein the revolving piece is mounted on the base body, and the draft bar penetrates the revolving piece and has one end thereof secured to a linking piece connected to the middle latch mechanism, such that when the push handle is pressed, the revolving piece is driven to actuate the draft bar, making the middle latch mechanism be driven by the draft bar to respectively and simultaneously actuate the upper latch mechanism and the lower latch mechanism; wherein the upper latch mechanism and the lower latch mechanism each comprises (1) a latching frame, (2) a latching support shiftably mounted in the latching frame, (3) a latching body shiftably disposed in the latching support, (4) a stop piece shiftably disposed in the latching frame and the latching support;

wherein the stop piece is in contact with the latching body so as to move the latching body between a position where the latching body is retracted into the latching support and a position where the latching body is extended outside the latching support, and (5) a second driving piece having one side thereof pivotally connected to the stop piece and the other side thereof directly connected to the middle latch mechanism by a pull rod, such that the second driving piece receives force from the middle latch mechanism to move the stop piece and the latching body, wherein the latching body is formed with a stop portion corresponding in position to the stop piece, to allow the stop piece to abut against the stop portion and hold the latching body in the extended position, and wherein the latching frame and the latching support are formed with guide slots corresponding to each other.

2. The fire-blocking door lock structure of claim 1, wherein the middle latch mechanism comprises a slide support mounted on the plate member, a latch block shiftably and pivotally mounted in the slide support, a first driving piece shiftably connected to the slide support and the latch block, and a sliding block having one side thereof pivotally connected to the first driving piece and the other side thereof connected to the linking piece.

3. The fire-blocking door lock structure of claim 2, wherein the latch block is formed with a recess portion for preventing the latch block from contact with the casing during movement of the latch block.

4. A fire-blocking door lock structure mounted on a fire-blocking door comprising a frame member, a push handle and a casing, the casing fixed to a plate member and connected to a base body, the fire-blocking door lock structure comprising:

a middle latch mechanism mounted in the casing, comprising a slide support mounted on the plate member, a latch block shiftably and pivotally mounted in the slide support, a first driving piece shiftably connected to the slide support and the latch block, and a sliding block having one side thereof pivotally connected to the first driving piece and the other side thereof connected to a linking piece;

an upper latch mechanism and a lower latch mechanism symmetrically mounted on opposite sides of the middle latch mechanism, the upper latch mechanism and the lower latch mechanism each comprising: (1) a latching frame, (2) a latching support shiftably mounted in the latching frame, (3) a latching body shiftably disposed in the latching support, (4) a stop piece shiftably disposed in the latching frame and the latching support, wherein the stop piece is in contact with the latching body so as to move the latching body between a position where the latching body is retracted into the latching support and a position where the latching body is extended outside the latching support, and (5) a second driving piece having one side thereof pivotally connected to the stop piece and the other side thereof directly connected to the linking piece, such that the second driving piece receives force from the middle latch mechanism to move the stop piece and the latching body; and an actuation mechanism connected to the sliding block of the middle latch mechanism, wherein when the push handle is pressed, the actuation mechanism is driven to actuate the middle latch mechanism, making the latch block of the middle latch mechanism be driven to respectively and simultaneously actuate the upper latch mechanism and the lower latch mechanism, wherein the latching body is formed with a stop portion corresponding in position to the stop piece, to allow the stop piece to abut against the stop portion and hold the latching body in the extended position, and wherein the latching frame and the latching support are formed with guide slots corresponding to each other.

5. The fire-blocking door lock structure of claim 4, wherein the actuation mechanism comprises at least one revolving piece secured to the base body, and a draft bar penetrating the revolving piece and having one end thereof fixed to the linking piece connected with the sliding block.

6. The fire-blocking door lock structure of claim 4, wherein the latch block is formed with a recess portion for preventing the latch block from contact with the casing during movement of the latch block.

7. A fire-blocking door lock structure mounted on a fire-blocking door comprising a frame member, a push handle and a casing, the casing fixed to a plate member and connected to a base body, the fire-blocking door lock structure comprising:

a middle latch mechanism mounted in the casing, comprising a slide support mounted on the plate member, a latch block shiftably and pivotally secured in the slide support, a first driving piece shiftably connected to the slide support and the latch block, and a sliding block having one side thereof pivotally connected to the first driving piece and the other side thereof connected to a pull rod;

an upper latch mechanism and a lower latch mechanism symmetrically mounted on opposite sides of the middle latch mechanism, the upper latch mechanism and the lower latch mechanism each comprising: (1) a latching frame, (2) a latching support shiftably mounted in the latching frame, (3) a latching body shiftably disposed in the latching support, (4) a stop piece shiftably disposed in the latching frame and the latching support, wherein the stop piece is in contact with the latching body so as to move the latching body between a position where the latching body is retracted into the latching support and a position where the latching body is extended outside the latching support, and (5) a second driving piece having one side thereof pivotally connected to the stop piece and the other side thereof directly connected to the pull rod, such that the second driving piece receives force from the middle latch mechanism to move the stop piece and the latching body; and an actuation mechanism connected to the sliding block of the middle latch mechanism, comprising at least one revolving piece and a draft bar, wherein the revolving piece is mounted on the base body, and the draft bar penetrates the revolving piece and has one end thereof secured to a linking piece connected to the sliding block of the middle latch mechanism, such that when the push handle is pressed, the revolving piece is driven to actuate the draft bar, and the middle latch mechanism is actuated by the draft bar, making the latch block of the middle latch mechanism be driven to respectively and simultaneously actuate the upper latch mechanism and the lower latch mechanism, wherein the latching frame and the latching support are formed with guide slots corresponding to each other.

8. The fire-blocking door lock structure of claim 7, wherein the slide support is substantially located at a center position on the plate member.

9. The fire-blocking door lock structure of claim 7, wherein the latch block is pivotally connected to a front end of the slide support.

10. The fire-blocking door lock structure of claim 7, wherein the first driving piece of the middle latch mechanism comprises a first corner shiftably and pivotally connected to the sliding block, a second corner pivotally connected to the slide support, and a third corner pivotally connected to the latch block.

11. The fire-blocking door lock structure of claim 7, wherein the latch block is formed with a recess portion for preventing the latch block from contact with the casing during movement of the latch block.

12. The fire-blocking door lock structure of claim 7, wherein the latching frame receives the latching support, the latching body, the stop piece and the second driving piece therein.

13. The fire-blocking door lock structure of claim 7, wherein the latching support receives the latching body, the stop piece, and the second driving piece therein.

14. The fire-blocking door lock structure of claim 7, wherein the latching body is formed with a stop portion corresponding in position to the stop piece, to allow the stop piece to abut against the stop portion and hold the latching body in the extended position.

* * * * *